US007942236B2

(12) United States Patent
Hagiwara

(10) Patent No.: US 7,942,236 B2
(45) Date of Patent: May 17, 2011

(54) EXHAUST DEVICE FOR STRADDLE-TYPE VEHICLE AND STRADDLE-TYPE VEHICLE

(75) Inventor: Itsurou Hagiwara, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 5 days.

(21) Appl. No.: 12/323,444

(22) Filed: Nov. 25, 2008

(65) Prior Publication Data

US 2009/0139796 A1 Jun. 4, 2009

(30) Foreign Application Priority Data

Nov. 30, 2007 (JP) ..... 2007-311702

(51) Int. Cl.
*F01N 1/10* (2006.01)
*F01N 1/02* (2006.01)
*F01N 1/24* (2006.01)

(52) U.S. Cl. ..... 181/252; 181/249; 181/250; 181/256; 181/257

(58) Field of Classification Search ..... 181/252, 181/249, 250, 256, 257
See application file for complete search history.

(56) References Cited

U.S. PATENT DOCUMENTS

| | | | | |
|---|---|---|---|---|
| 3,786,791 | A * | 1/1974 | Richardson | 123/65 EM |
| 4,109,755 | A * | 8/1978 | Grueneberg | 181/256 |
| 4,113,051 | A * | 9/1978 | Moller | 181/231 |
| 4,164,266 | A * | 8/1979 | Collin et al. | 181/250 |
| 4,185,715 | A * | 1/1980 | Reu Boiu | 181/266 |
| 4,192,402 | A * | 3/1980 | Nakagawa et al. | 181/256 |
| 4,263,981 | A * | 4/1981 | Weiss et al. | 181/252 |
| 4,501,341 | A * | 2/1985 | Jones | 181/250 |
| 4,846,302 | A * | 7/1989 | Hetherington | 181/243 |
| 5,350,888 | A * | 9/1994 | Sager et al. | 181/247 |
| 5,365,025 | A * | 11/1994 | Kraai et al. | 181/249 |
| 5,660,571 | A * | 8/1997 | Nakayasu et al. | 440/88 R |
| 6,571,910 | B2 * | 6/2003 | Storm | 181/264 |
| 7,549,510 | B2 * | 6/2009 | Sakurai et al. | 181/252 |
| 2002/0121404 | A1 | 9/2002 | Storm | |
| 2004/0262077 | A1 * | 12/2004 | Huff et al. | 181/250 |
| 2005/0161283 | A1 * | 7/2005 | Emler | 181/249 |
| 2006/0086563 | A1 * | 4/2006 | Lucas | 181/230 |
| 2007/0044747 | A1 * | 3/2007 | Sawatari et al. | 123/184.21 |

(Continued)

FOREIGN PATENT DOCUMENTS

EP 1 840 342 A1 10/2007

(Continued)

OTHER PUBLICATIONS

European Search Report, Mar. 4, 2009, for European Patent Application No. EP 08 25 3568.

(Continued)

*Primary Examiner* — Jeffrey Donels
*Assistant Examiner* — Christina Russell
(74) *Attorney, Agent, or Firm* — Keating & Bennett, LLP

(57) ABSTRACT

An exhaust device for a straddle-type vehicle that satisfies the requirements of sound deadening characteristics and which has a reduced size is provided. The exhaust device for a straddle-type vehicle that includes an exhaust pipe connected to an engine and a silencer connected to the exhaust pipe. The silencer includes at least one resonator selected from a group consisting of a Helmholtz resonator and a side branch resonator. The resonator is packed with a sound absorbing material.

10 Claims, 32 Drawing Sheets

U.S. PATENT DOCUMENTS

| | | | | |
|---|---|---|---|---|
| 2007/0102236 | A1* | 5/2007 | Uhlemann et al. | 181/250 |
| 2007/0227808 | A1* | 10/2007 | Sakurai et al. | 181/249 |
| 2007/0227810 | A1* | 10/2007 | Sakurai et al. | 181/251 |
| 2008/0023265 | A1* | 1/2008 | Frederiksen et al. | 181/257 |
| 2008/0240950 | A1* | 10/2008 | McGill et al. | 417/437 |
| 2008/0308061 | A1* | 12/2008 | Yokota | 123/184.57 |
| 2009/0272601 | A1* | 11/2009 | Hagiwara | 181/249 |

FOREIGN PATENT DOCUMENTS

| | | | |
|---|---|---|---|
| EP | 1 840 345 | A1 | 10/2007 |
| EP | 1 921 286 | A1 | 5/2008 |
| JP | 59-43455 | | 10/1981 |
| JP | 62 038815 | A | 2/1987 |
| JP | 08312324 | | 11/1996 |
| JP | 2005 220871 | A | 8/2005 |

OTHER PUBLICATIONS

European Search Report, Aug. 11, 2009, for European Patent App. No. 08 253 568.

* cited by examiner

EXHAUST DEVICE FOR STRADDLE-TYPE VEHICLE AND STRADDLE-TYPE VEHICLE

PRIORITY INFORMATION

This patent application is based on and claims priority under 35 U.S.C. §119 to Japanese Patent Application No. 2007-311702, filed on Nov. 30, 2007, which is hereby incorporated by reference.

TECHNICAL FIELD

The present invention relates to an exhaust device for a straddle-type vehicle and to a straddle-type vehicle.

BACKGROUND

A muffler, or exhaust device, used for a straddle-type vehicle (such as a motorcycle), has opposing design requirements. A muffler or exhaust device is required to effectively exhaust gas from an engine with high efficiency (that is, exhibit high exhaust efficiency) and simultaneously reduce or deaden exhaust sound caused by the exhaust gas that has been brought to high pressure and high temperature.

In recent years, noise regulations have been tightened and hence the need for reducing or deadening sound has been increased. Thus, it has been desired to maintain exhaust efficiency while reducing or further deadening the exhaust sound. One example of a muffler for a motorcycle that attempts to address the competing requirements of exhaust efficiency and sound deadening is described in Japanese Examined Utility Model Publication NO. 59-43455.

When the design of a muffler is considered in terms of only exhaust efficiency, it is most desirable that the muffler (or exhaust system) be kept as straight as possible. However, when the muffler is extended straightly, the muffler cannot be housed in the vehicle body of a motorcycle. Thus, to reduce resistance to exhaust, the muffler is designed to be extended towards the back of the vehicle body with as subtle of bends as possible. However, in reality, the design of the muffler in this manner is made difficult in many cases because of the connection with the front wheel and the consideration of the bank angle. Usually, a muffler having an ideal length in terms of engine performance, is very difficult to house in the body of the motorcycle without being changed in shape. Thus, the designing of a muffler having a length as close to the best length in terms of performance as possible, which keeps as smooth a shape as possible, and which is housed within the body of a motorcycle, involves an extensive design process, as compared with the designing of a muffler for a four-wheel passenger car.

Moreover, in addition to the exhaust efficiency, the weight of the muffler is an important design criteria. A motorcycle typically has a light vehicle body, and hence even a weight increase of 1 kg may have a large effect on the drivability of the motorcycle. Further, in addition to the weight of the muffler, arranging of the center of gravity of the muffler at a remote position will have a bad effect on the drivability of the motorcycle.

It is difficult, however, to reduce the weight of a motorcycle muffler because no matter how skillfully the structure of a muffler is designed, the muffler is required to have a certain amount of volume in order to enhance the effect of sound deadening. In many cases, when a muffler is adapted to stricter noise regulation requirements, the muffler needs to be enlarged in size, thereby increasing its weight.

If the metal plate used in construction of the muffler is made thinner to offset the weight increase, the metal plate will vibrate and cause large noises. As a result, mufflers of enlarged size tend to have increased weight, which in turn impairs the drivability of the motorcycle.

In this manner, the structure of the motorcycle is determined in consideration of various opposing design factors, so that it is extremely difficult to realize a muffler that satisfies exhaust efficiency and sound deadening characteristics and which has a reduced size.

SUMMARY OF THE INVENTION

The present invention has been made in view of the above-mentioned problems. To this end, it is an object of the present invention to provide a muffler for a straddle-type vehicle that satisfies the requirements of sound deadening and which has a reduced size.

An exhaust device for a straddle-type vehicle according to the present invention includes: an exhaust pipe connected to an engine; and a silencer connected to the exhaust pipe. The silencer has at least one resonator selected from the group consisting of a Helmholtz resonator and a side branch resonator, and the resonator is packed with a sound absorbing material.

As noted above, the silencer has at least one resonator selected from a group consisting of a Helmholtz resonator and a side branch resonator, and the resonator is packed with a sound absorbing material. Thus, a peak of an attenuation level at a resonance frequency, which is newly developed by the resonator, is reduced. As a result, even when the volume of the silencer cannot be enlarged because the concomitant increase in weight of the muffler would be unacceptable, the effect of deadening sound can be enhanced.

DETAILED DESCRIPTION

The design of the exhaust device (muffler) for a motorcycle has been performed under various limitations. However, if the volume of a muffler is not increased, the effect of deadening sound cannot be enhanced. On the other hand, the phenomenon that an increase in the volume of the muffler causes a decrease in the drivability of the motorcycle cannot be avoided. For example, in the muffler of an actual 4-cycle motocross motorcycle, if the volume of a silencer is increased to satisfy a decrease in noise while maintaining running performance, the muffler is actually increased in size and weight. Because noise regulations need to be satisfied, it is impossible to neglect the factor of noise and to reduce the size and weight of the muffler.

Under these conditions, the present inventor has tried to realize an exhaust device (muffler) having a silencer that can satisfy running performance (exhaust characteristics) and noise characteristics, and which is small in size and weight and has earnestly conducted a study of the exhaust device. This endeavor has lead the present inventor to the different embodiments of the invention described herein.

Hereinafter, various embodiments of the present invention will be described with reference to the drawings. For the sake of simplifying the description, in the following drawings the constituent elements having substantially the same functions are denoted by the same reference symbols. It is to be expressly understood, however, that the present invention is not limited to the embodiments described below. Instead, other embodiments may be utilized and structural changes may be made without departing from the scope of the present invention as defined in the claims below.

Figure 1:
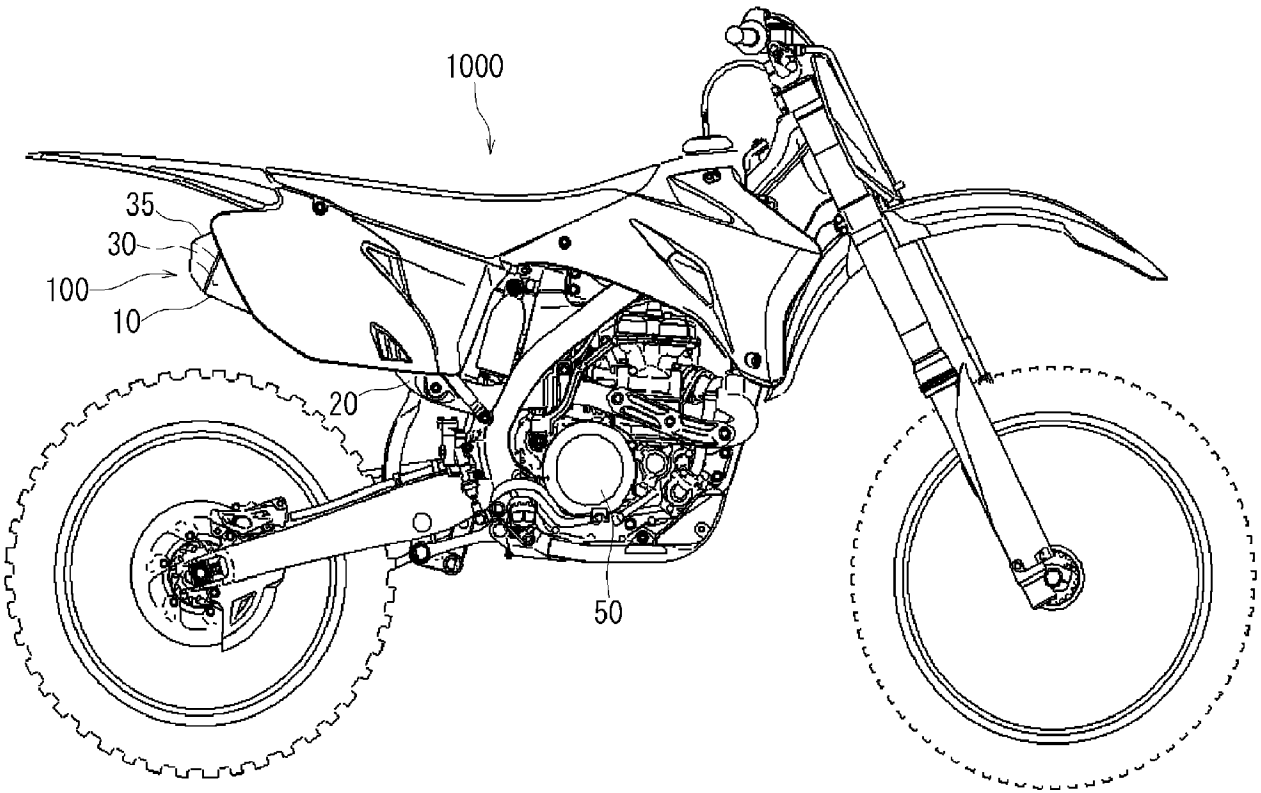
FIG. 1 illustrates a side view of a motorcycle 1000 provided with an exhaust device 100 according to an embodiment of the present invention.

FIG. 1 shows a motorcycle 1000 mounted with an exhaust device (or muffler) 100 according to an embodiment of the present invention. The exhaust device 100 of this embodiment is constructed of: an exhaust pipe 20 connected to an engine 50; and a silencer 10 connected to the exhaust pipe 20.

In the example shown in FIG. 1, the silencer 10 has a tail pipe 30 arranged on the rear end (downstream side) thereof. Moreover, the tail pipe 30 is covered by a tail cap 35. For the sake of convenience, the engine 50 side is referred to as an "upstream" side, and an atmospheric side, or rear end side, of the silencer 10 is referred to as a "downstream" side.

Figure 2:
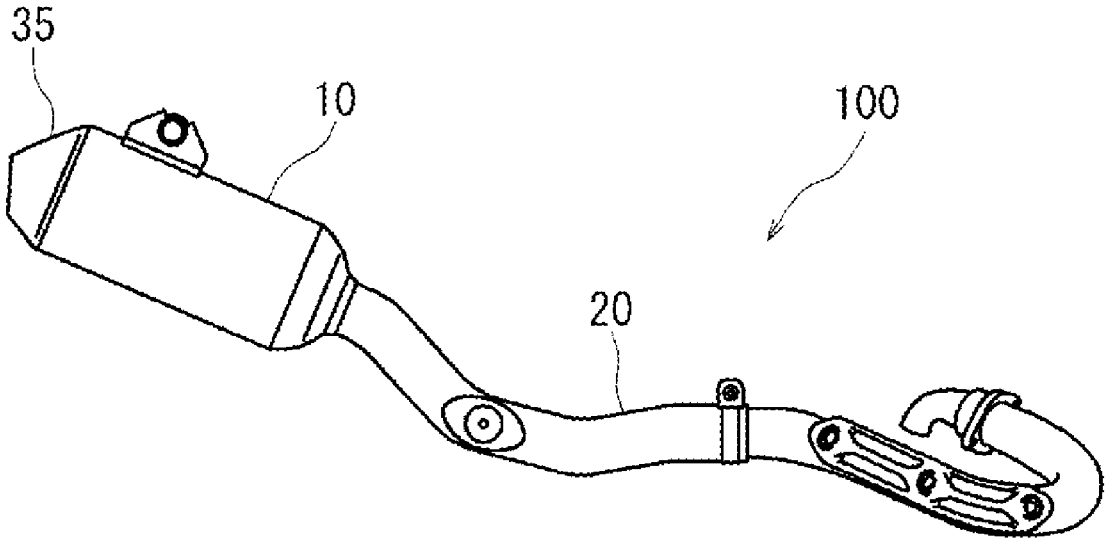
FIG. 2 illustrates a diagram to show the exhaust device 100 according to the embodiment of the present invention.

FIG. 2 illustrates the exhaust device 100 of this embodiment removed from the motorcycle 1000. The exhaust pipe 20 and the silencer 10 of the exhaust device 100 shown in FIG. 2 has fixing members formed thereon, the fixing members being used to fix the exhaust device 100 to a vehicle body. The muffler 100 of this embodiment is a muffler for a 4-cycle engine, and the motorcycle 1000 shown in FIG. 1 is an off-road type vehicle. Here, the silencer 10 is a muffler fixed to the rear portion of the exhaust device 100, specifically the rear portion of the exhaust pipe 20.

The silencer 10 of this embodiment has at least one resonator selected from a group consisting of a Helmholtz resonator and a side branch resonator, and the at least one resonator (namely, the Helmholtz resonator and/or side branch resonator) is packed with sound absorbing material.

The resonator is selected from the group consisting of the Helmholtz resonator and the side branch resonator according to the application. The basic structure of a Helmholtz resonator is shown in FIG. 3, and the basic structure of a side branch resonator is illustrated in FIG. 4.

Figure 3:
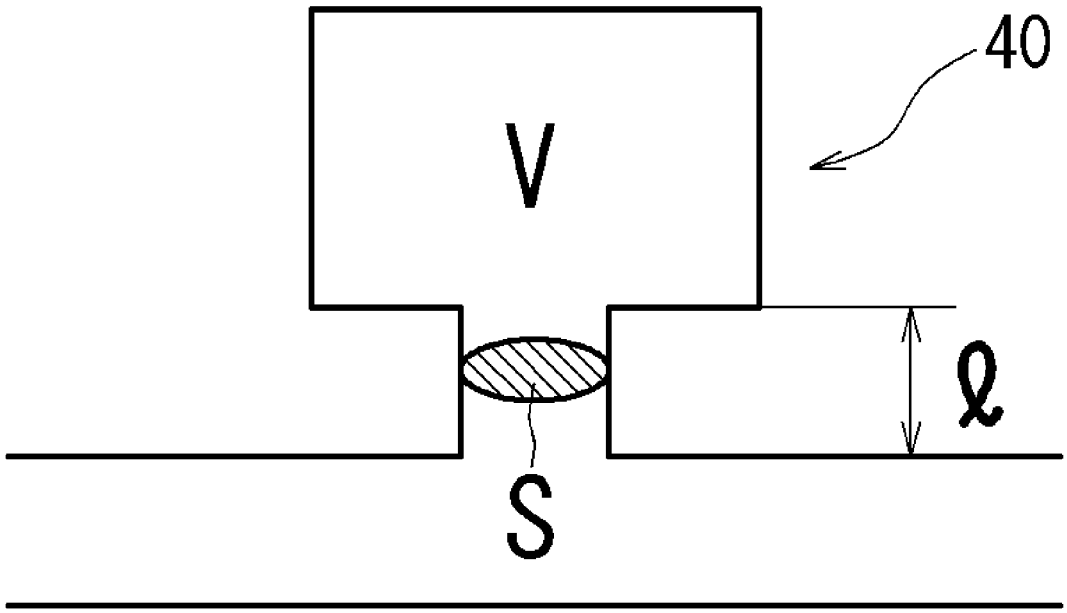
FIG. 3 is a diagram to illustrate a Helmholtz resonator 40.
Figure 4:
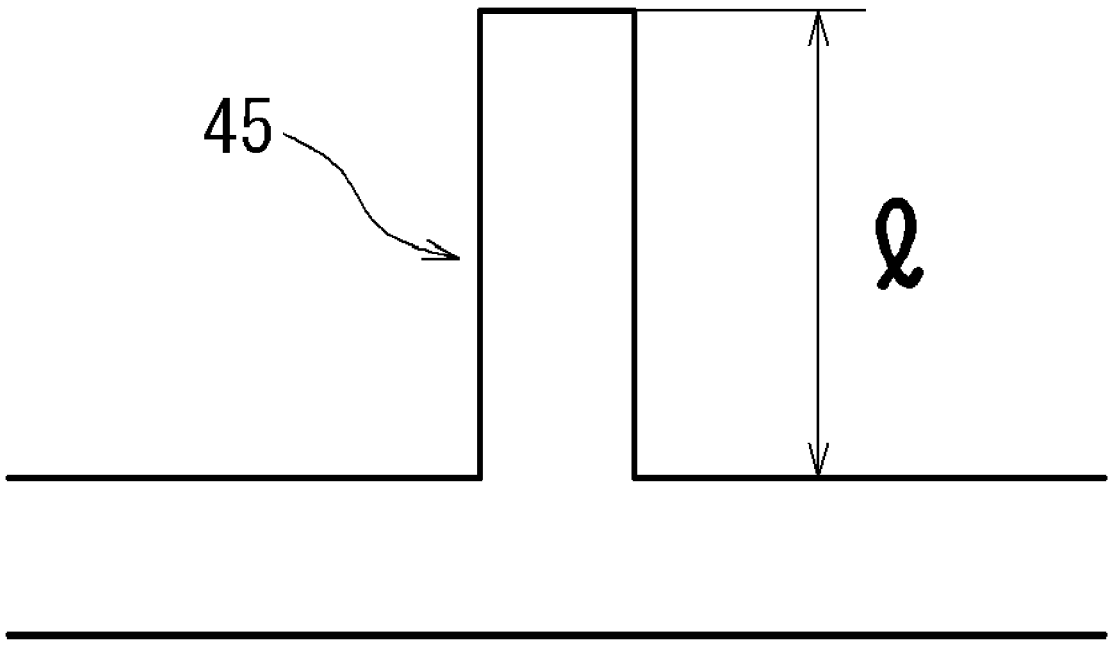
FIG. 4 is a diagram to illustrate a side branch resonator 45.

The resonance frequency $f_0$ of the Helmholtz resonator shown in FIG. 3 is found by Equation 1 below.

$$fo = \frac{c}{2\pi}\sqrt{\frac{S}{Vl}} \quad \text{(Hz)} \qquad \text{Equation 1}$$

c: sonic speed

V: volume l: length of a neck portion (including a correction of a pipe end)

S: cross-sectional area of the neck portion

By contrast, the resonance frequency f of the side branch resonator shown in FIG. 4 is found by Equation 2 below.

$$f = \frac{2n-1}{4} * \frac{c}{l} \quad \text{(Hz)} \qquad \text{Equation 2}$$

c: sonic speed l: is the length of a side branch (including a correction of a pipe end)

n: 1, 2, 3 . . . .

As shown by Equation 1, the Helmholtz resonator can have its resonance frequency adjusted by the diameter and length of the neck portion and the volume of a hollow portion and hence has a wide range of uses. The resonance frequency of the side branch resonator, by contrast, may be adjusted by the length of the resonator and the number of side branches.

When sound having a frequency close to the resonance frequency enters the resonator, great air vibration is developed by resonance. This violent air vibration is changed into heat by the viscid resistance of the medium, air friction loss, whereby the sound is absorbed. This is referred to as absorption or attenuation of sound. Here, "resonance" or "sympathetic vibration" means a phenomenon where the vibration energy of a certain substance is absorbed by another substance causing the other substance to vibrate.

When the resonator (namely, the Helmholtz resonator or the side branch resonator) is attached to a pipe line, in this case an exhaust system, improved attenuation can be produced near the resonance frequency of the resonator, but the attaching of the resonator causes a new sympathetic vibration, which results in a secondary problem.

In this regard, when sound enters a sound absorbing material (such as glass wool, stainless wool (SUS wool), porous metal, or the like), air vibration is directly transmitted to air in clearances or bubbles in the sound absorbing material and is absorbed by the viscid friction of air on the surfaces of the fibers and the bubbles or by the vibration of the fibers or the films themselves of the bubbles. Thus, when the resonator is packed with the sound absorbing material, the effect of absorbing sound produced by the resonator itself is decreased.

Here, in the construction of this embodiment, the decreasing of a new peak of an attenuation level at a resonance frequency is realized by oppositely utilizing the point that the effect of absorbing sound produced by the resonator itself may be decreased by the use of sound absorbing material. Thus, according to the exhaust device 100 of this embodiment, even when the volume of the silencer cannot be increased because the corresponding increase in the weight of the muffler would be unacceptable, the effect of deadening sound can be enhanced.

Describing this embodiment further, in the case of enhancing the performance of the engine, there is the diameter of a tail pipe required in terms of the performance of the engine. In the case of a muffler adapted to the noise regulation, the diameter of the tail pipe tends to become larger. When only the diameter of the tail pipe is increased, the resonance frequency $f_0$ in terms of the attenuation characteristics of the exhaust system shifts to a higher frequency. However, there exists the value of the resonance frequency $f_0$ required in terms of noise and the performance of the engine. Thus, the capacity of the entire exhaust system and the length of the tail pipe are adjusted in such a way that the resonance frequency $f_0$ of the resonator becomes the required value. In the case of adjusting only the length of the tail pipe, the length of the tail pipe becomes long and hence the resonance frequency of the pipe length shifts to a lower frequency. Usually, however, a deterioration in the attenuation characteristics in the range of low frequency leads to an increase in noise. Thus, the adjusting of only the length of the tail pipe is limited.

As a solution to this problem, this embodiment employs a structure in which the exhaust system is mounted with a resonator packed with the sound absorbing material, which can decrease a peak of the attenuation level in the mode of a tail pipe length. As a result, this embodiment can expand flexibility. The Helmholtz resonator or the resonator of the side branch can be used, and the most suitable resonator can be employed as appropriate for each application. Moreover, the exhaust system can be provided with the required attenuation characteristics by adjusting the sound absorbing material to be used and its apparent density.

Helmholtz Resonator Embodiments

The construction and the effect of the silencer 10 according to various embodiments of the present invention will now be described with reference to FIG. 5 to FIG. 10. Each of the silencers 10 described in connection with FIGS. 5 to 10 includes a Helmholtz resonator.

Figure 5B:
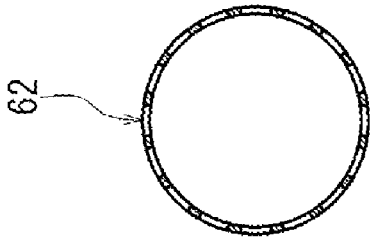
FIG. 5B illustrates a sectional view along a line B-B in FIG. 5A.
Figure 5A:
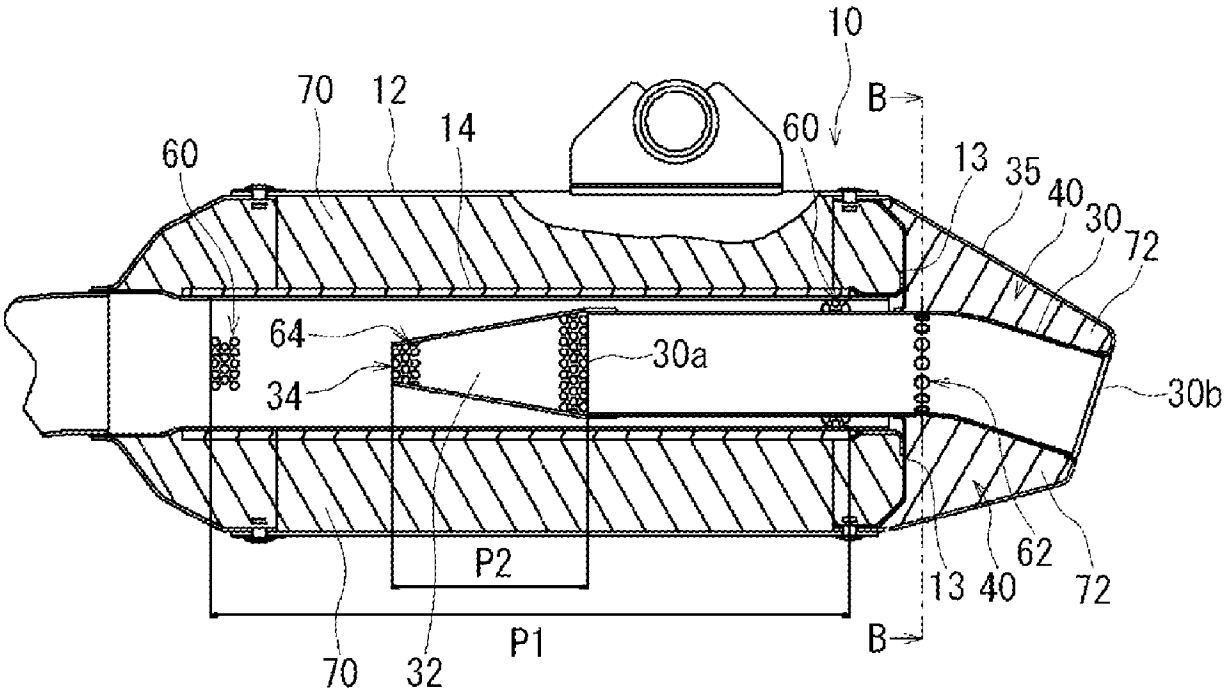
FIG. 5A illustrates a sectional view of a silencer 10 according to embodiment 1 of the present invention.

FIG. 5A is a longitudinal cross-sectional view of the silencer 10 according to a first embodiment, and FIG. 5B is a sectional view along a line B-B in FIG. 5A.

The silencer 10 shown in FIG. 5 has the tail pipe 30 arranged in the rear portion thereof, and the tail pipe 30 is covered by the tail cap 35. The tail cap 35 has the Helmholtz resonator 40 formed therein. The Helmholtz resonator 40 is packed with sound absorbing material (for example, glass wool) 72.

The silencer 10 is constructed of an outer cylinder 12 and an inner cylinder 14 housed in the outer cylinder 12. At least a portion (e.g., region P1) of the inner cylinder 14 of the silencer 10 has punched holes 60 formed therein.

The holes 60 are small holes formed in the interior, inner cylinder 14 in this case, of the silencer 10 and provide the capability of passing the energy of exhaust gas introduced from the exhaust pipe 20 to the outer cylinder 12 through the small holes. In the embodiment shown in FIG. 5, the space between the inner wall of the outer cylinder 12 and the outer wall of the inner cylinder 14 is packed with the sound absorbing material 70.

The sound absorbing material is a material capable of absorbing a sonic wave. For example, glass wool, stainless wool (SUS wool), aluminum wool, ferrite, or asbestos can be used as the sound absorbing material. In this embodiment, glass wool is used as the sound absorbing material 70. The sound absorbing material can effectively absorb high-frequency sound but cannot effectively absorb low-frequency sound, so that the exhaust device 100 or the silencer 10 is preferably designed in consideration of this point.

The inner cylinder 14 has the tail pipe 30 arranged in the center of a portion thereof. In this embodiment, the forward end 30*a* of the tail pipe 30 is positioned on the downstream side of the half way point in the longitudinal direction, of the inner cylinder 14. The rear end 30*b* of the tail pipe 30 is positioned on the downstream side of the rear end portion of the inner cylinder 14. Here, in this embodiment, a clearance air layer is formed between the tail pipe 30 and the inner cylinder 14.

In the example shown in the drawing, there is provided a partition plate 13 that connects and closes the downstream end surfaces of the outer cylinder 12 and the inner cylinder 14. The partition plate 13 forms the upstream boundary of the Helmholtz resonator 40 formed in the tail cap 35. A portion of the tail pipe 30 positioned on the downstream side of the partition plate 13 has through holes 62 formed therein. The interior of the tail pipe 30 connects to the interior of the tail cap 35 through these through holes 62 (see FIGS. 5A and 5B). With this, the Helmholtz resonator 40 having the tail cap 35 as a container is constructed. In the present embodiment, the tail pipe 30 is formed to include a downward bend from a point slightly downstream of the through holes 62.

When the Helmholtz resonator 40 shown in FIG. 5 is applied to the relationship shown in FIG. 3 and the Equation 1, the respective items are as follows: the sectional area S of the neck portion is the total sum of the opening areas of the through holes 62; the length l of the neck portion is the thickness of the tail pipe 30; and the volume V is a volume formed by the tail pipe 30, the tail cap 35, and the partition plate 13.

As shown in FIG. 5B, the tail pipe 30 of the present embodiment, has 16 through holes 62 formed therein. Each of the through holes 62 is circular and a specified diameter. The Helmholtz resonator 40 has a specified volume V. In addition, the interior of the Helmholtz resonator 40 is packed with glass wool 72.

The tail pipe 30 also includes a punched cone 32 disposed on the front end 30*a* thereof. The punched cone 32 shown in FIG. 5A is a member that has a tip end formed in the shape of an open cone and which has punched holes 64 formed in the cone-shaped side surface. The punched cone 32 can produce the effect of deadening sound and, in particular, can reduce exhaust sound leaking to the outside of the silencer 10. The punched cone 32 shown in FIG. 5A has punched holes 64 formed in a region P2.

The opening 34 positioned at the upstream end of the punched cone 32 is smaller than the diameter of an opening of a downstream end of the punched cone 32, the diameter of which corresponds to an opening of the front end 30*a* of the tail pipe 30. This configuration can prevent the exhaust sound from leaking to the outside of the silencer 10 and can enhance the effect of deadening the exhaust sound. Here, as for the punched cone 32, one or more punched cones can be arranged in the interior of the silencer 10 (e.g., the inner cylinder 14, in this case). Moreover, the tip of the punched cone 32 can be formed with an opening 34 as illustrated in FIG. 5A, but may also be formed with a closed end.

Figure 6B:
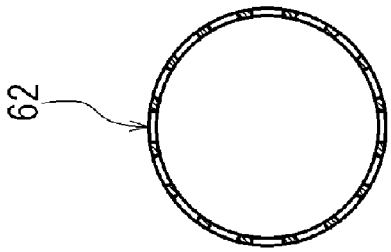
FIG. 6B illustrates a sectional view along a line B-B in FIG. 6A.
Figure 6A:
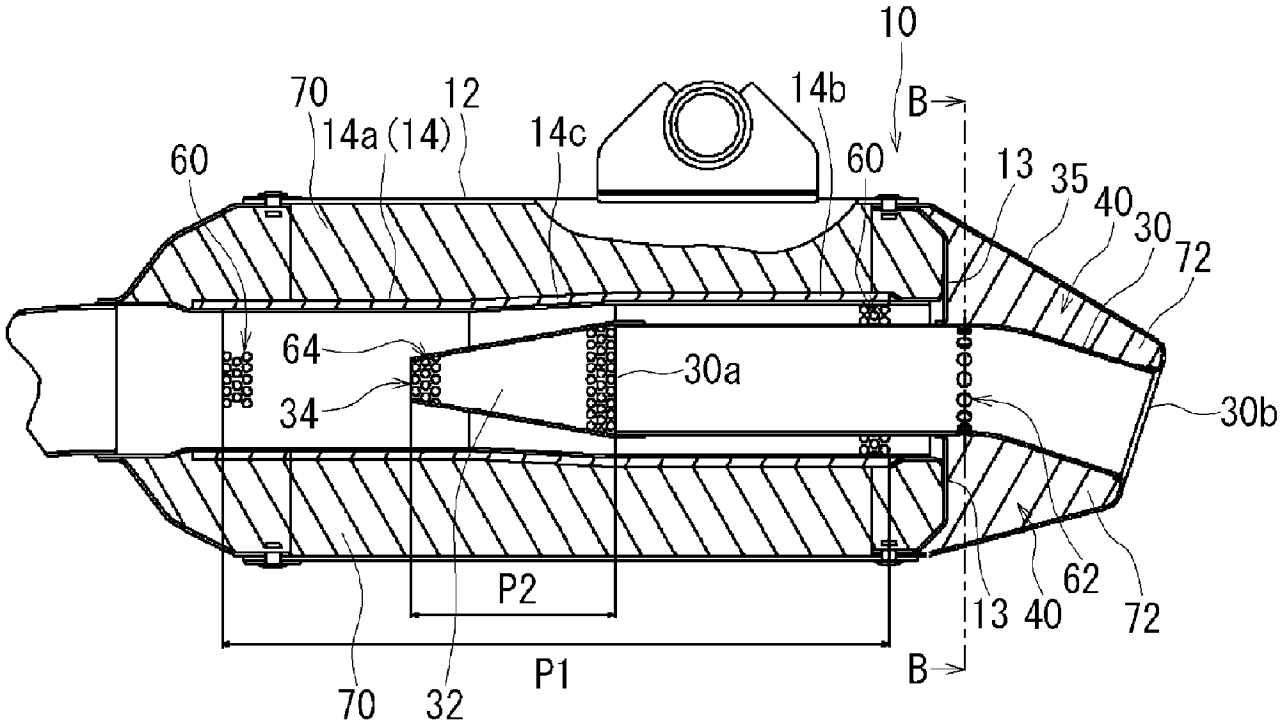
FIG. 6A illustrates a sectional view of a silencer 10 according to the embodiment 2 of the present invention.

FIGS. 6A and 6B illustrate a modified embodiment of the silencer 10 shown in FIG. 5. The modified embodiment shown in FIGS. 6A and 6B has basically the same construction as shown in FIG. 5 and has the Helmholtz resonator 40 formed in the tail cap 35. However, the modified embodiment shown in FIGS. 6A and 6B is different with respect to the construction of the inner cylinder 14 from the silencer 10 shown in FIG. 5. Specifically, the diameter of a downstream portion 14*b* of the inner cylinder 14 is larger than the diameter of an upstream portion 14*a* of the inner cylinder 14. Here, a transition portion the diameter of which is expanded by a tapered middle portion 14*c* is interposed between the upstream portion 14*a* and the downstream portion 14*b*. As a result, in the silencer 10 shown in FIGS. 6A and 6B, the inside diameter of the inner cylinder 14 is changed (expanded in this case) from the upstream side to the downstream side, whereby the sound deadening characteristics can be adjusted.

Figure 7:
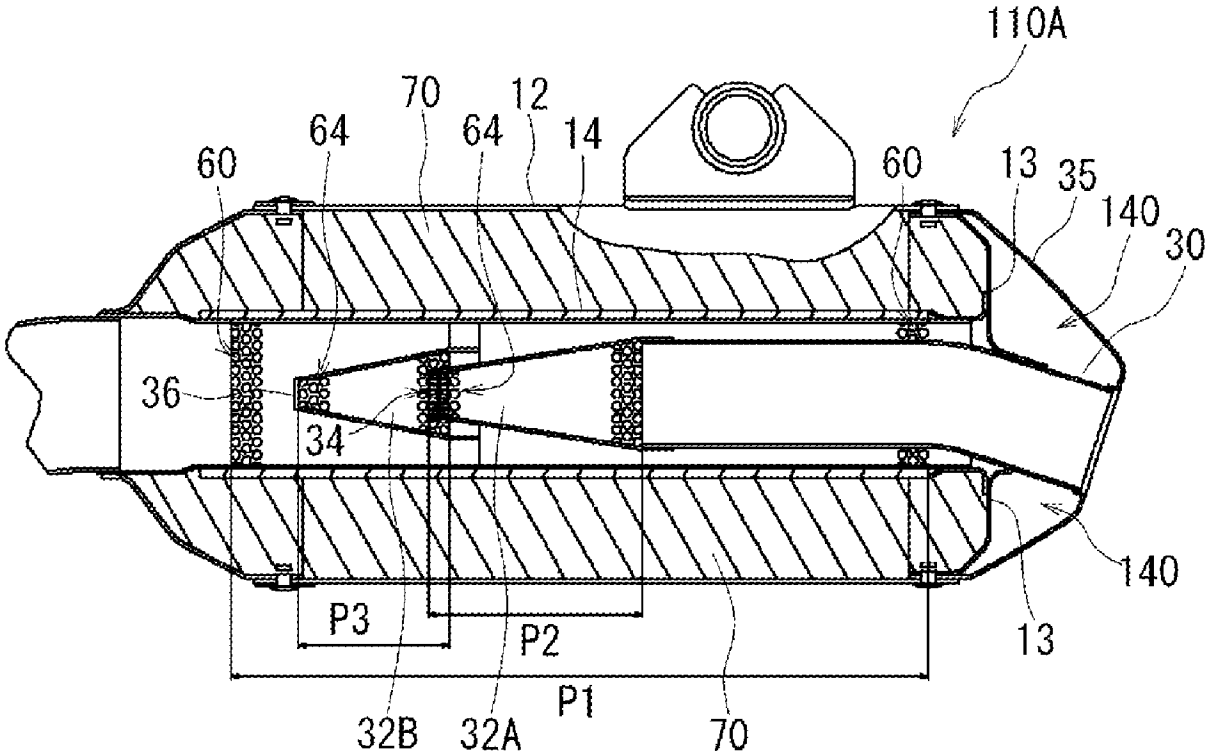
FIG. 7 illustrates a sectional view of a silencer 110A of a comparative example.
Figure 8:
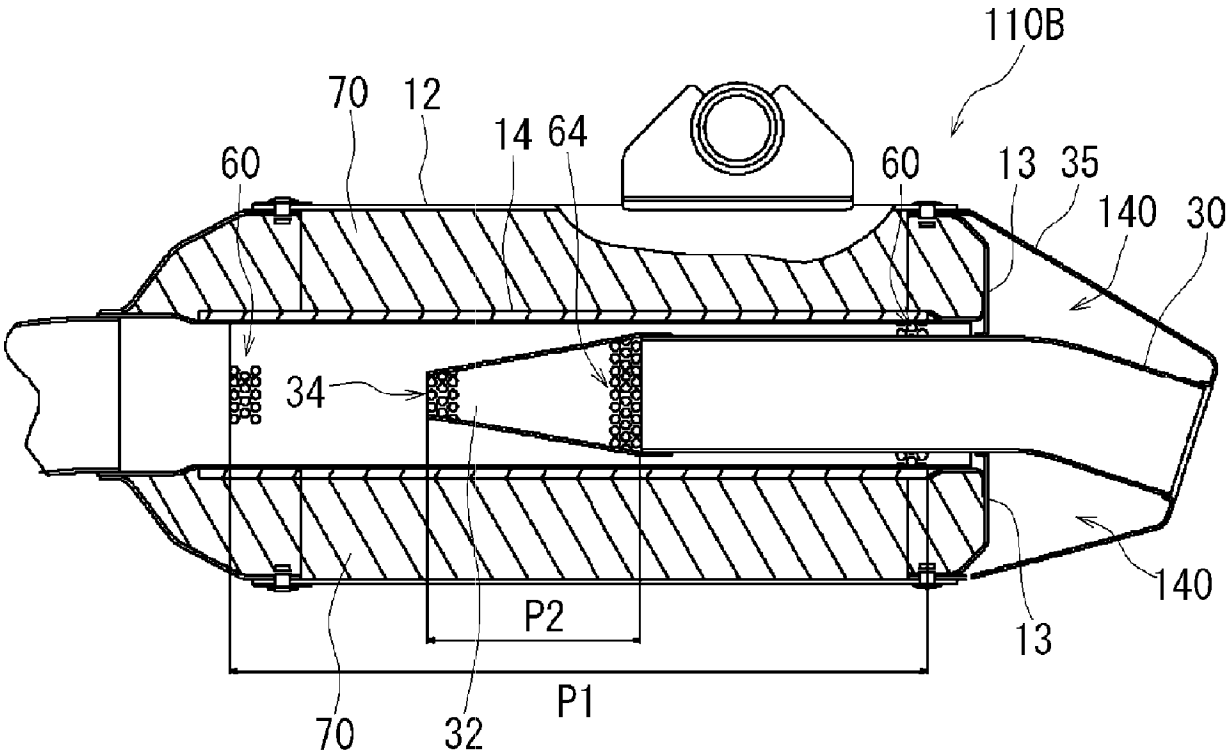
FIG. 8 illustrates a sectional view of a silencer 110B of a comparative example.

FIG. 7 and FIG. 8 are sectional views to show the constructions of silencers of comparative examples 110A, and 110B respectively. The silencers 110A and 110B shown in FIG. 7 and FIG. 8 do not have the Helmholtz resonator 40 formed therein. Furthermore, the tail caps 35, of the silencers 110A and 110B, have only hollow portions 140 formed therein. In other words, the interiors of the tail caps 35 are not connected to the interiors of the tail pipe 30.

Other than the lack of the Helmholtz resonator 40, the silencers 110A and 110B of the comparative examples have constructions that are similar in other respects to the silencer shown in FIG. 5. The tail pipe 30 of the silencer 110B shown in FIG. 8 is different from the tail pipe 30 of the silencer 110A shown in FIG. 7 in the point that the tail pipe 30 of the silencer 110B is larger in diameter and longer than the tail pipe 30 of the silencer 110A. Thus, the resonance frequency of the silencer 110B shown in FIG. 8 becomes a low frequency and hence has a disadvantage in terms of reducing noises.

In this regard, the silencer 110A shown in FIG. 7 has two steps of punched cones 32 (3A, 32B) disposed therein. The punched cone 32A is the same as the punched cone 32 shown in FIG. 5A. On the other hand, the punched cone 32B has its tip 36 closed. Moreover, the punched cone 32A has the punched holes 64 formed in the region P2, whereas the punched cone 32B has the punched holes 64 formed in a region P3.

In contrast, the silencer 110B shown in FIG. 8, like the construction shown in FIG. 5, has one punched cone 32 disposed therein. Moreover, except for not having through holes 62, the tail pipe 30 shown in FIG. 7 has the same construction as that shown in FIG. 5.

Figure 9:
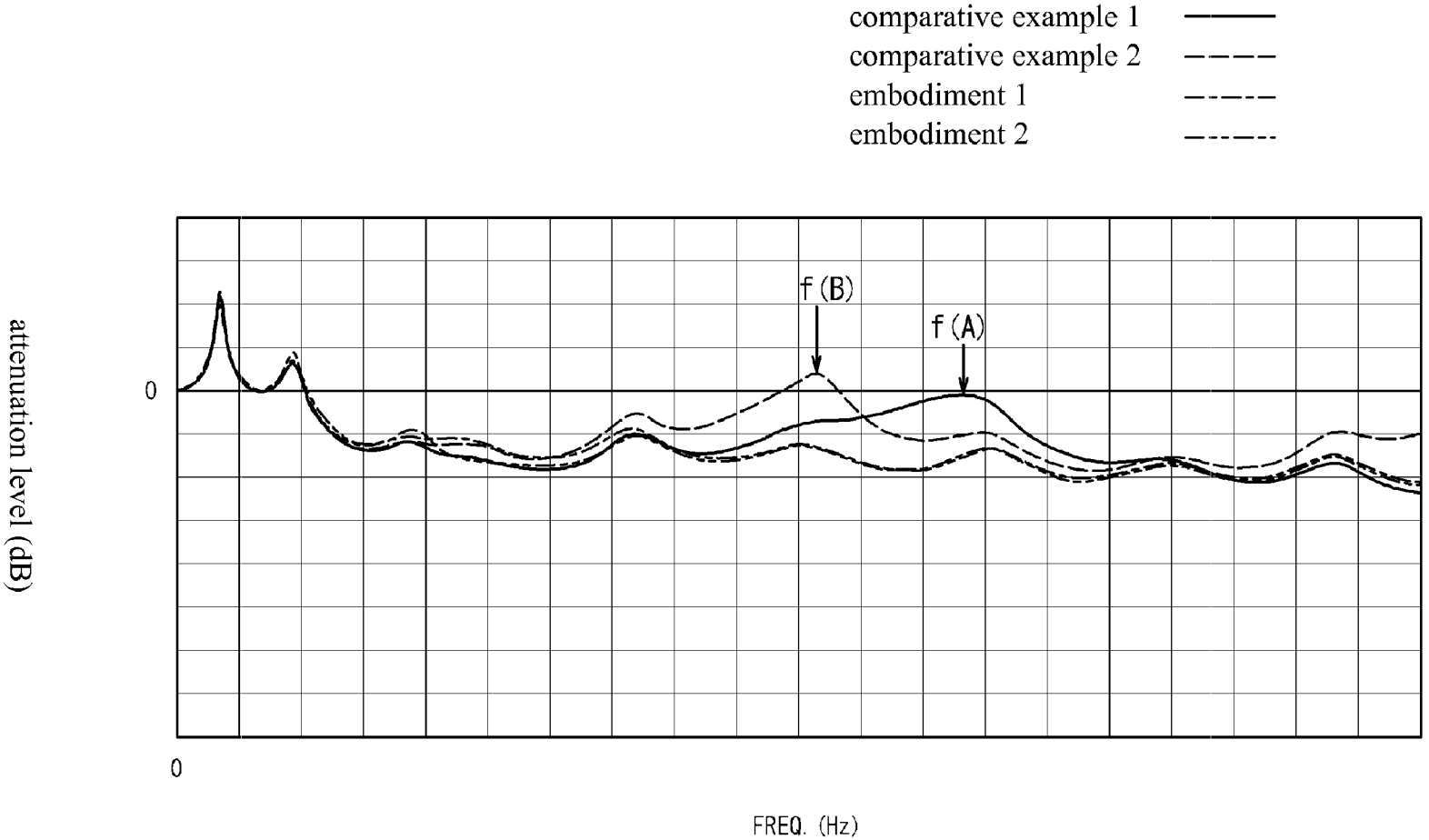
FIG. 9 is a graph showing the effect of the silencers according to embodiments 1 and 2 of the present invention on the attenuation characteristics of the muffler.

Next, the effect of the silencer 10 according to the embodiments shown in FIGS. 5 and 6 will be described with reference to FIG. 9. FIG. 9 shows the result of a simulation study of the silencer 10 according to the embodiments of FIGS. 5 and 6 that was conducted by the present inventor. FIG. 9 is a graph showing the attenuation characteristics of the silencer 10 according to the illustrated embodiments. In the drawing, the vertical axis shows an attenuation level (dB) and the lateral axis shows a frequency (Hz). The silencers studied here are the silencer having the structure 10 shown in FIGS.

5A and 5B (embodiment 1), the silencer having the structure 10 shown in FIGS. 6A and 6B (embodiment 2), the silencer having the structure 110A shown in FIG. 7 (comparative example 1), and the silencer having the structure 110B shown in FIG. 8 (comparative example 2). Here, the density (apparent density) of the glass wool 72 charged into the Helmholtz resonator 40 in embodiment 1 is the same as that in embodiment 2.

As shown in FIG. 9, it can be found that the attenuation characteristics of the silencers of embodiment 1 and embodiment 2 are better than those of the comparative examples 1, 2. Because of the way embodiment 1 and embodiment 2 are constructed, the attenuation level (dB) of the frequency f of the silencer 10 can be made lower than the attenuation level (dB) of the frequency f(A) of comparative example 1 and the attenuation level (dB) of the frequency f(B) of comparative example 2. Further, it can be found that the attenuation characteristics of embodiment 1 and embodiment 2 are generally better than those of the comparative examples 1, 2 in other frequency ranges as well.

Figure 10:
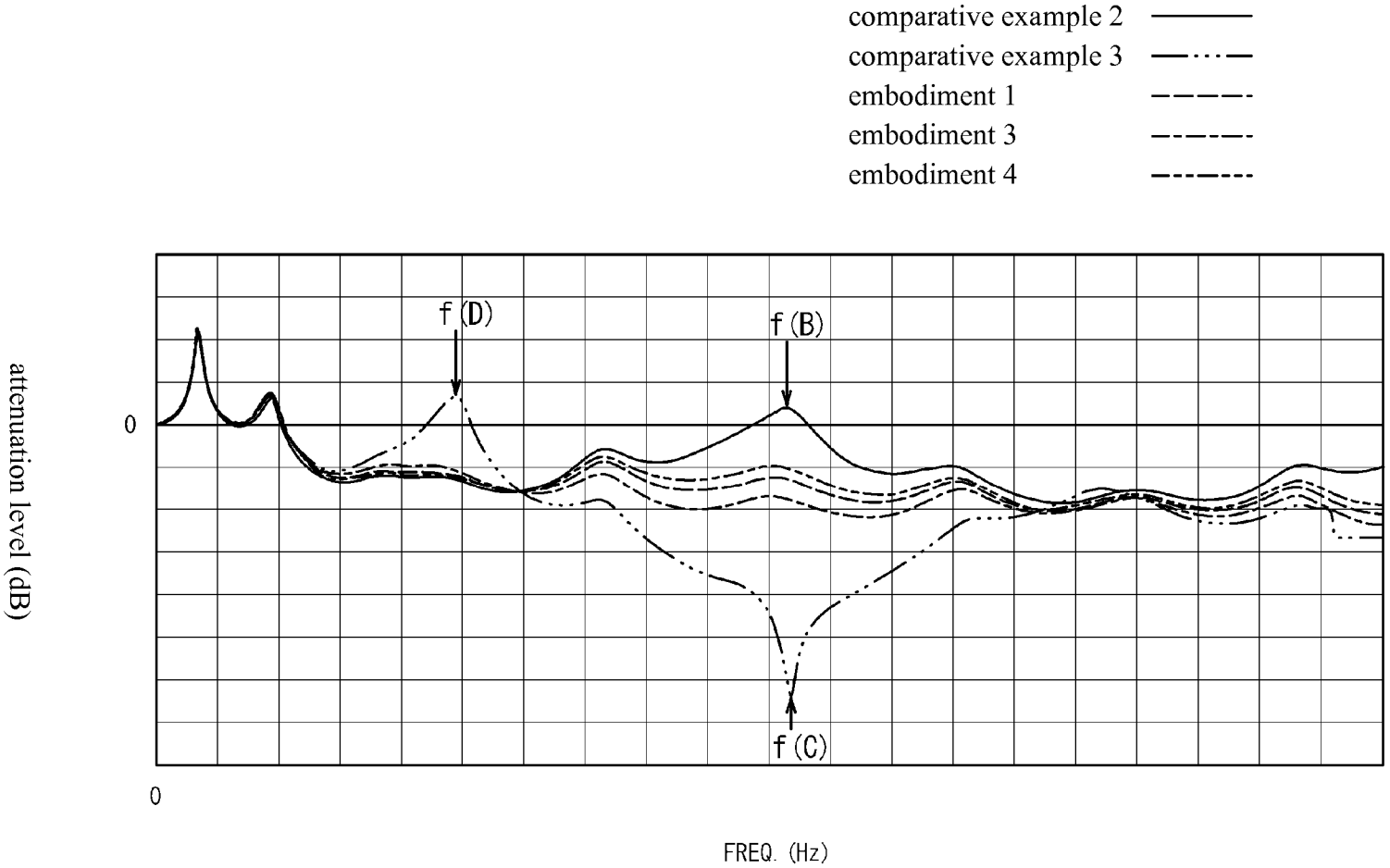
FIG. 10 is a graph showing the effect of the silencer according to embodiments 1, 3 and 4 of the present invention on the attenuation characteristics of a muffler.

FIG. 10 shows the results obtained when the density (apparent density) of the sound absorbing material (glass wool) 72 packed into the Helmholtz resonator 40 in the construction shown in FIG. 5 is changed. In FIG. 10, the embodiment 1 and the comparative example 2 have been described above. Comparative example 3 is for a resonator that is not packed with the glass wool 72 of the embodiment 1. In other words, the apparent density of the sound absorbing material 72 is 0 $kg/m^3$. Embodiment 3, on the other hand, is for a resonator charged with glass wool having a density ⅓ times the density of the glass wool 72 of embodiment 1, and embodiment 4 is for a resonator charged with glass wool having a density ⅔ times the density of the glass wool 72 of embodiment 1. Here, the apparent density of the sound absorbing material (e.g., glass wool) 72 is a density expressed by the mass (kg) of the sound absorbing material 72 packed into the Helmholtz resonator 40 with respect to the volume ($m^3$) of the Helmholtz resonator 40.

As shown in FIG. 10, the comparative example 3 having the Helmholtz resonator 40 without the sound absorbing material, can greatly reduce the attenuation level of the frequency f(C) as compared with the comparative example 2 not having the Helmholtz resonator 40. However, the comparative example 3 develops a new peak of the attenuation level at a frequency f(D) and gets out of balance, which results in contrarily impairing the attenuation characteristics. On the other hand, the embodiments 1, 3, and 4 prevent such a new peak of the attenuation level from being developed and hence show better attenuation characteristics than the comparative example 1 and the comparative example 3.

The silencer 10 of the above-described embodiments is provided with the Helmholtz resonator 40, and the Helmholtz resonator 40 is packed with the sound absorbing material 72. Thus, the attenuation characteristics can be enhanced by the Helmholtz resonator 40, and the peak of the attenuation level at the resonance frequency, which is newly developed by the Helmholtz resonator 40, can be prevented by packing the Helmholtz resonator 40 with the sound absorbing material 72. As a result, even when the volume of the silencer cannot be increased so as to prevent an increase in the weight of the muffler, the effect of deadening sound can be enhanced. In particular, according to the construction of the foregoing embodiments, the Helmholtz resonator 40 is formed in the tail cap 35 to thereby prevent the volume of the silencer from being increased more than required. This is an additional benefit of the construction of the Helmholtz resonator embodiments according to the present invention.

Now, additional modified embodiments of the embodiment shown in FIG. 5 will be described with reference to FIG. 11 to FIG. 14.

Figure 11B:
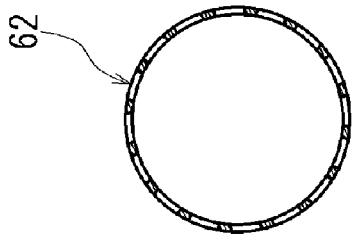
FIG. 11B illustrates a sectional view along a line B-B in FIG. 11A.
Figure 11A:
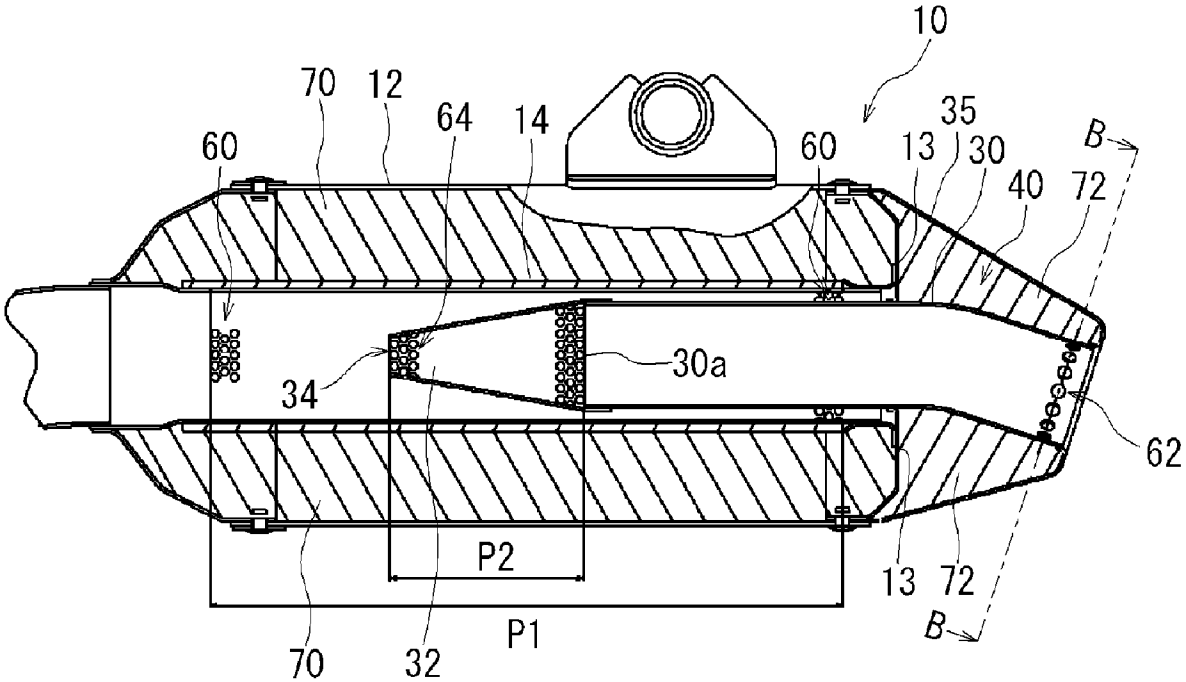
FIG. 11A illustrates a sectional view of a silencer 10 according to the embodiment 5 of the present invention.

FIGS. 11A and 11B illustrate cross-sectional views of a modified silencer having a construction similar to that shown in FIG. 5 and which has a Helmholtz resonator 40 formed in the tail cap 35. FIG. 11A is a longitudinal cross-sectional view of the modified embodiment, and FIG. 11B is a sectional view along line B-B in FIG. 11A. The modified embodiment (embodiment 5) shown in FIGS. 11A and 11B is different from the construction shown in FIGS. 5A and 5B because the through holes 62 are formed on the downstream side (or opening end side) of the tail pipe 30. In the modified embodiment shown in FIG. 11A, the number of through holes 62 is sixteen as in the embodiment shown in FIGS. 5A and 5B.

Figure 12B:
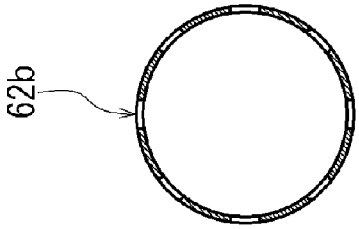
FIG. 12B illustrates a sectional view along a line B-B in FIG. 12A.
Figure 12C:
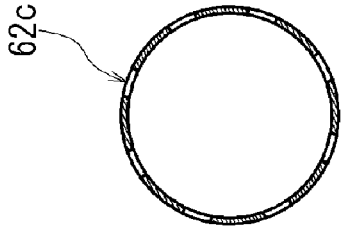
FIG. 12C illustrates a sectional view along a line C-C in FIG. 12A.
Figure 12A:
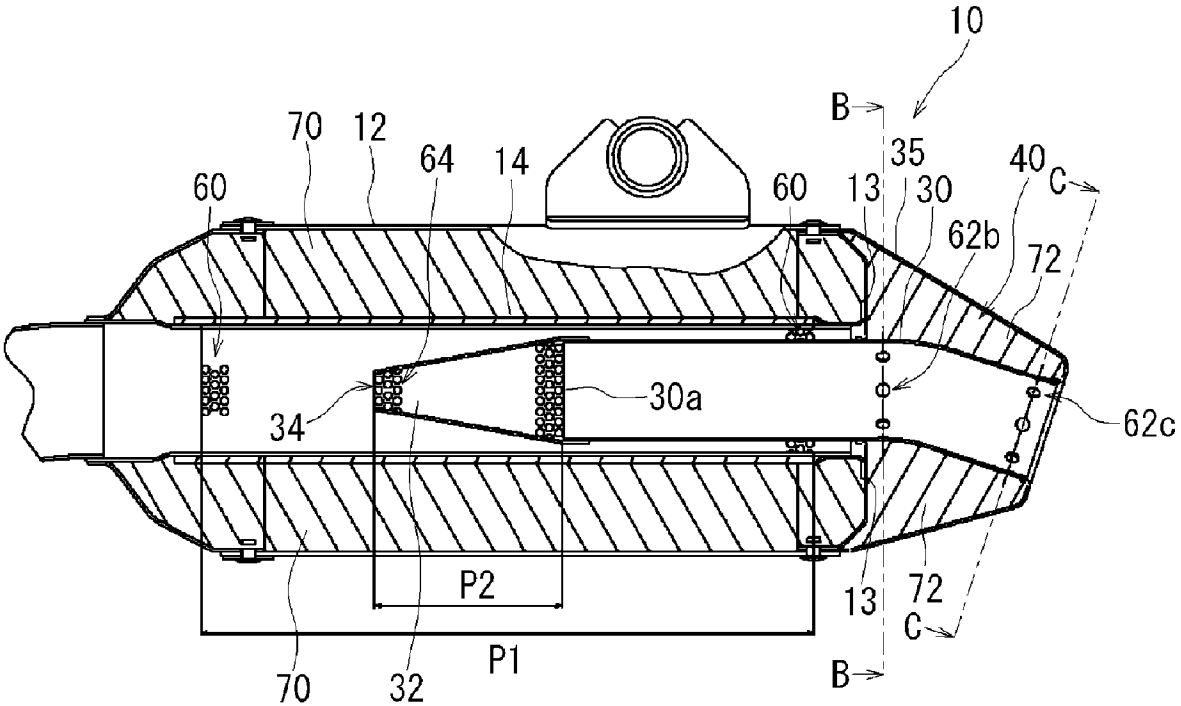
FIG. 12A illustrates a sectional view of a silencer 10 according to the embodiment 6 of the present invention.
Figure 13B:
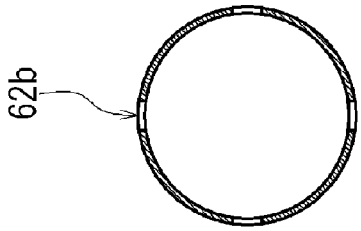
FIG. 13B a sectional view along a line B-B in FIG. 13A.
Figure 13C:
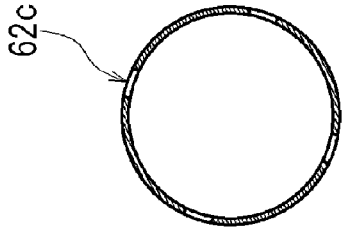
FIG. 13C illustrates a sectional view along a line C-C in FIG. 13A.
Figure 13A:
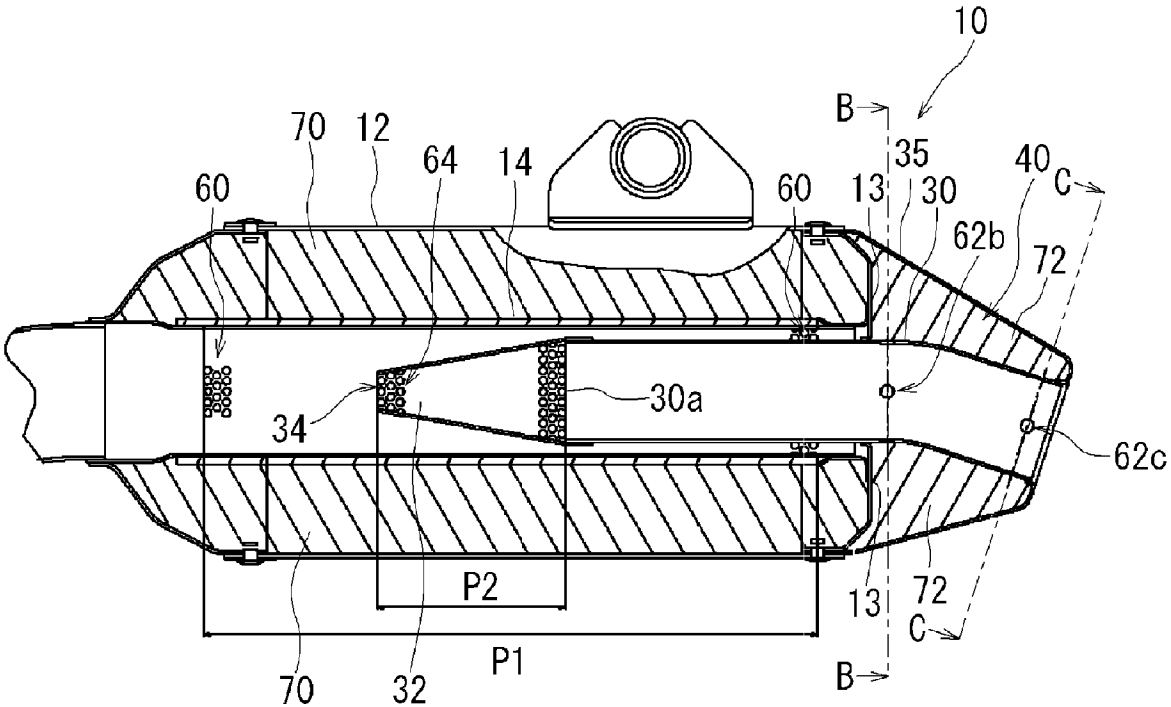
FIG. 13A illustrates a sectional view of a silencer 10 according to embodiment 7 of the present invention.

FIG. 12A shows a longitudinal cross-sectional view of a modified embodiment (embodiment 6) of the silencer 10 according to the embodiment shown in FIG. 5. FIGS. 12B and 12C are sectional views along line B-B and line C-C in FIG. 12A, respectively. Further, FIG. 13A is also a longitudinal cross-sectional view of a modified embodiment (embodiment 7) of the silencer 10 of FIG. 5. FIGS. 13B and 13C are sectional views along line B-B and line C-C in FIG. 13A, respectively.

The modified embodiments 6 and 7 shown in FIGS. 12 and 13 are different from the above-described embodiments because they have through holes 62 formed in both the central portion and downstream side of the tail pipe 30. Through holes 62*b* are formed in the central portion, the same position as in the construction shown in FIG. 5, of the tail pipe 30 and through holes 62*c* are formed on the downstream side (or opening end side) of the tail pipe 30 like the modified embodiment 5 shown in FIG. 11. In the modified embodiment 6 shown in FIG. 12, the number of the through holes 62*b* is eight, and the number of the through holes 62*c* is eight. In the modified embodiment 7 shown in FIG. 13, the number of the through holes 62*b* is four, and the number of the through holes 62*c* is four.

Figure 14:
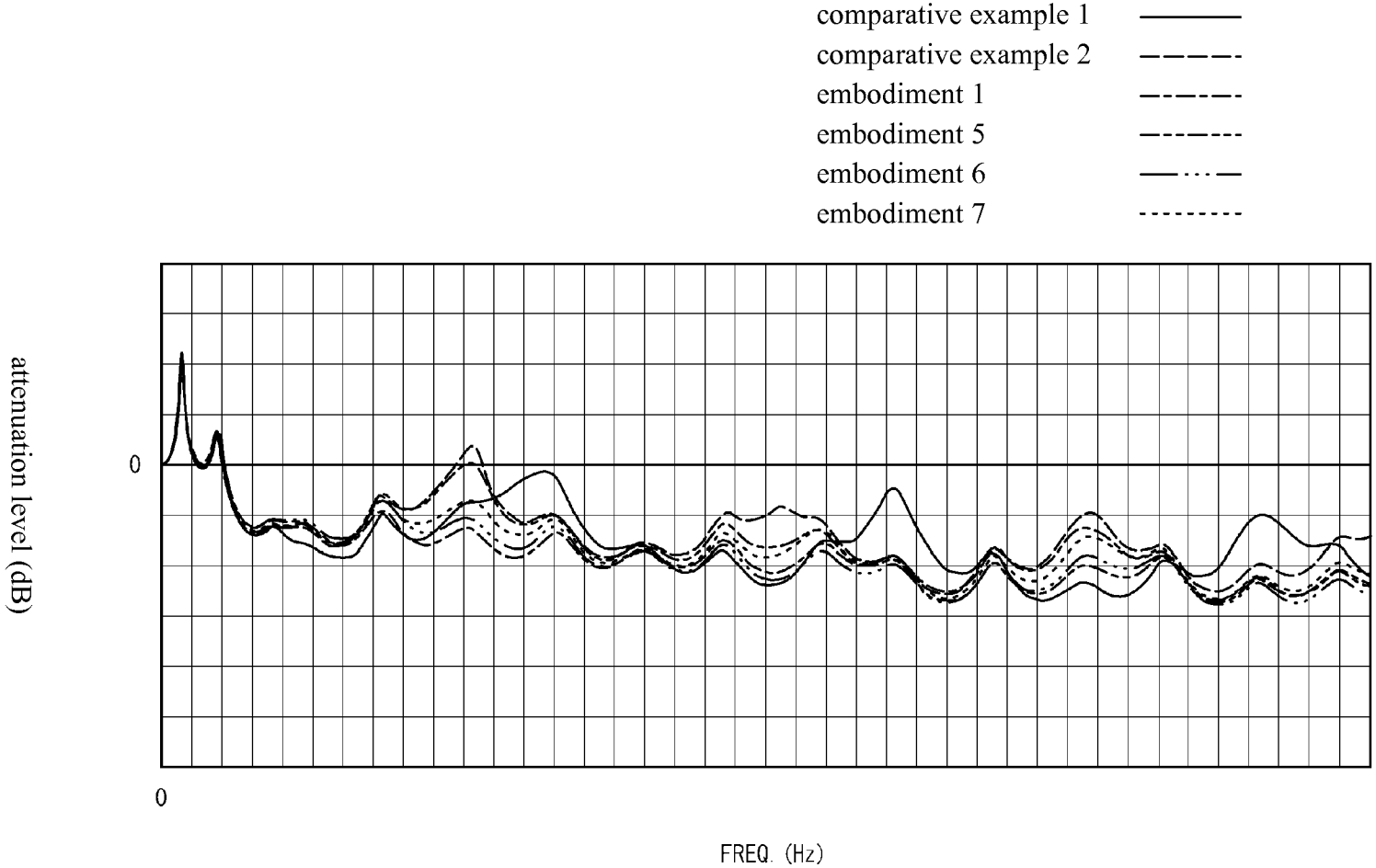
FIG. 14 is a graph showing the effect of silencers according to embodiments 1, 5, 6, and 7 of the present invention on the attenuation characteristics of a muffler.

FIG. 14 is a graph showing the effect of the silencer 10 of modified embodiments 5, 6 and 7, and is similar to FIGS. 9 and 10 in construction. The silencers compared in FIG. 14 are the silencers of comparative example 1, comparative example 2, embodiment 1, embodiment 5 shown in FIG. 11, embodiment 6 shown in FIG. 12, and embodiment 7 shown in FIG. 13, all of which have been described above. For purposes of the comparison, the density (apparent density) of the glass wool 72 packed into the Helmholtz resonators 40 in the embodiment 1 and the embodiments 5 to 7 were set equal to each other.

As shown in FIG. 14, it can be seen that the attenuation characteristics of a silencer having a Helmholtz resonator 40 (such as that included in embodiment 1 and embodiments 5 to 7) is better than those of the comparative examples 1 and 2. It can be further seen that among the embodiments, the embodiments 1, 6, and 7 having the through holes 62 formed at least in the central portion exhibit better attenuation characteristics than the embodiment 5 having the through holes 62 formed only on the downstream side (or opening end side) of the tail pipe 30.

It is thus preferable that the through holes 62 are formed at positions where sound pressure is high. In other words, to reduce a primary peak of the attenuation level at a resonance frequency developed by the length of the tail pipe, it suffices to form the through holes 62 nearly in the center of the tail pipe where a primary sound pressure becomes high. On the other hand, the effect of the through holes 62 near the opening end becomes small.

However, the through holes 62 can be formed at arbitrary positions in accordance with the manufacturing conditions and other conditions. For example, to reduce a secondary peak of the attenuation level at a resonance frequency developed by the length of the tail pipe in addition to the effect of reducing the primary peak of the attenuation level, the through holes 62 can be also additionally formed at a position of ¾ of the length of the tail pipe. Further, in the modified embodiments shown in FIGS. 11 and 12, the number of through holes 62*b* is not required to be equal, but may be different from, the number of through holes 62*c*.

Additional modified embodiments of the silencer 10 shown in FIG. 5 are described in connection with FIGS. 15 to 18. FIGS. 15A to 17A are longitudinal cross-sectional views illustrating modified embodiments of the silencer 10 shown in FIG. 5. FIGS. 15B to 17B and FIGS. 15C to 17C are sectional views along line B-B and line C-C in FIGS. 15A to 17A, respectively. In each of the constructions shown in FIGS. 15 to 17, the number of the through holes 62*b* formed in the central portion is different from the number of the through holes 62*c* formed on the downstream side (or opening end side). More specifically, in each of these constructions, the number of the through holes 62*b* formed in the central portion is made greater than the number of the through holes 62*c* formed on the downstream side (or opening end side).

Figure 15B:
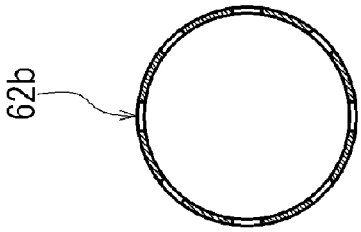
FIG. 15B illustrates a sectional view along a line B-B in FIG. 15A.
Figure 15C:
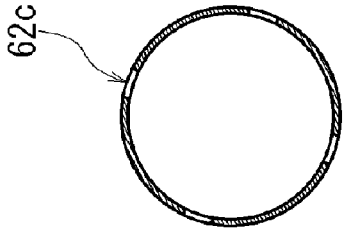
FIG. 15C illustrates a sectional view along a line C-C in FIG. 15A.
Figure 15A:
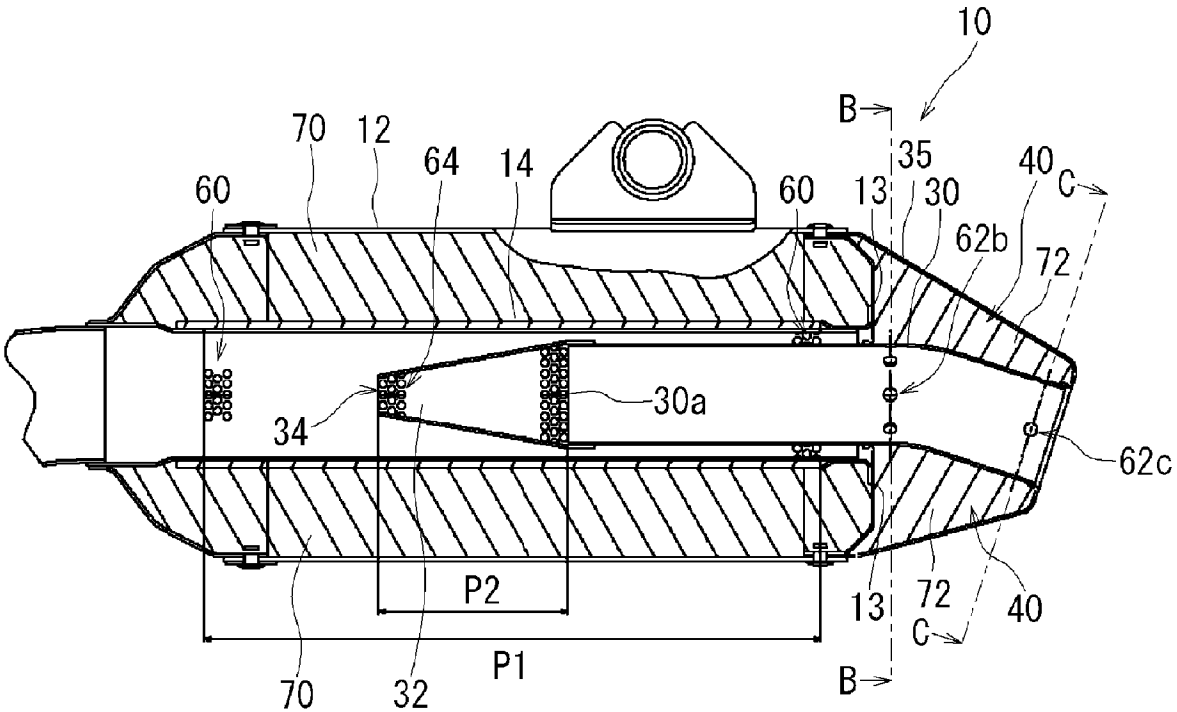
FIG. 15A illustrates a sectional view of a silencer 10 according to embodiment 8 of the present invention.
Figure 16B:
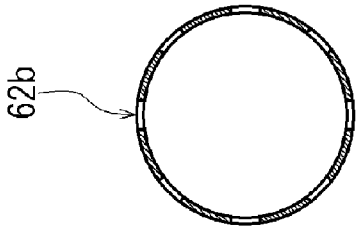
FIG. 16B illustrates a sectional view along a line B-B in FIG. 16A.
Figure 16C:
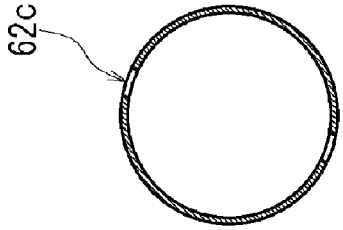
FIG. 16C illustrates a sectional view along a line C-C in FIG. 16A.
Figure 16A:
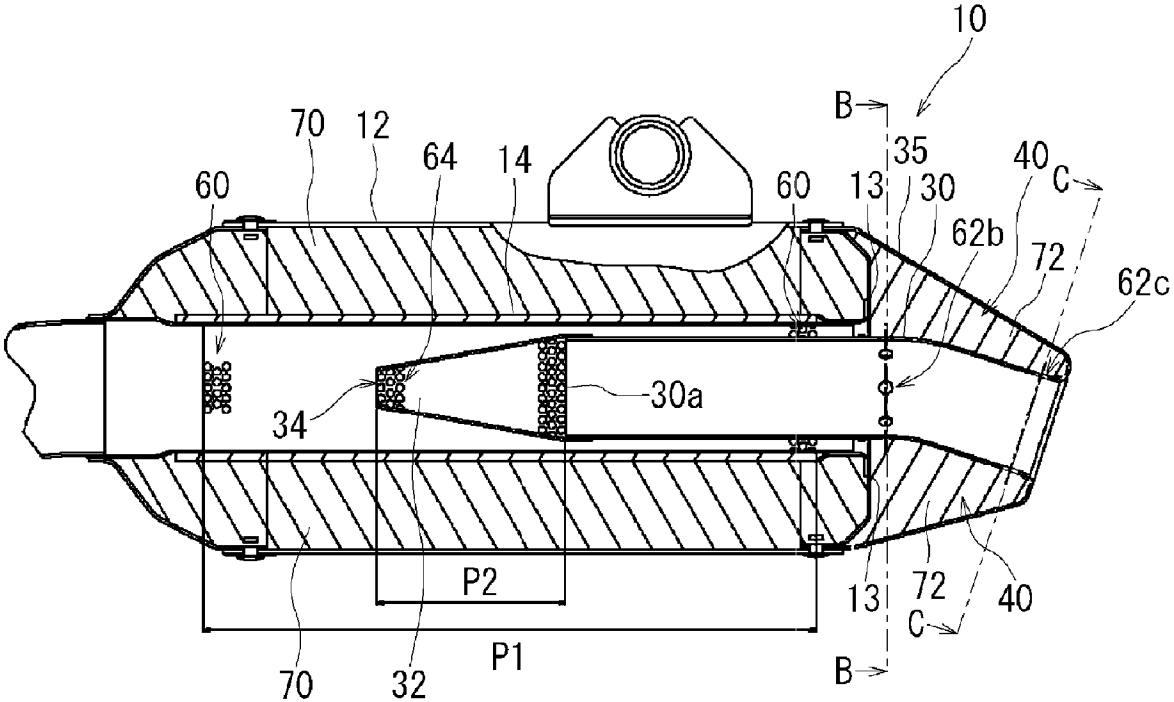
FIG. 16A illustrates a sectional view of a silencer 10 according to embodiment 9 of the present invention.
Figure 17B:
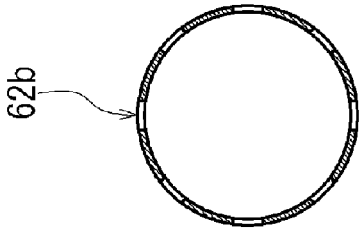
FIG. 17B illustrates a sectional view along a line B-B in FIG. 17A.
Figure 17C:
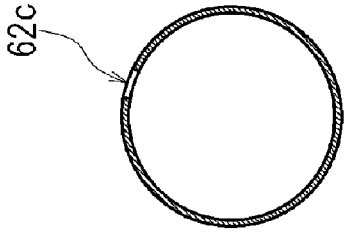
FIG. 17C illustrates a sectional view along a line C-C in FIG. 17A.
Figure 17A:
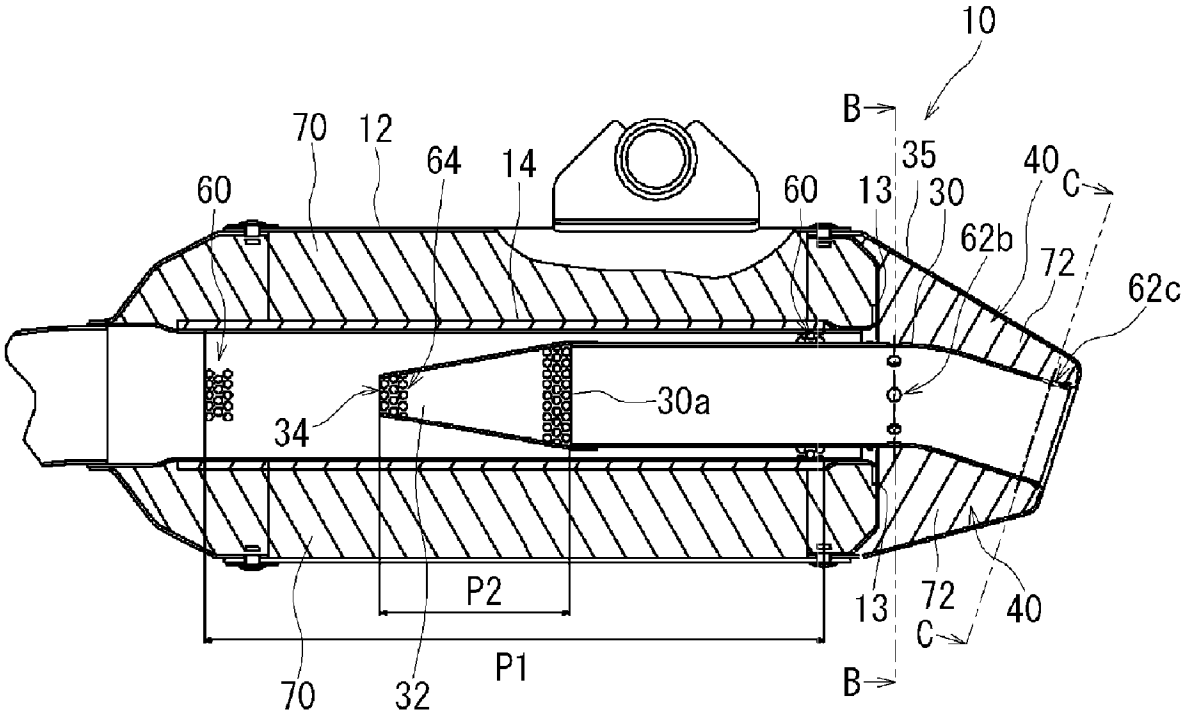
FIG. 17A illustrates a sectional view of a silencer 10 according to embodiment 10 of the present invention.

The diameters of the through holes 62*b* and 62*c* shown in FIG. 15 to FIG. 17 are equal to each other. The number of the through holes 62*b* shown in FIG. 15 is eight, whereas the number of the through holes 62*c* shown in FIG. 15 is four. The number of the through holes 62*b* shown in FIG. 16 is eight, whereas the number of the through holes 62*c* shown in FIG. 16 is two. The number of the through holes 62*b* shown in FIG. 17 is eight, whereas the number of the through holes 62*c* shown in FIG. 17 is one. In other words, in the embodiments shown in FIG. 15 to FIG. 17, the number of the through holes 62*b* is fixed to eight, whereas the number of the through holes 62*c* is changed.

Figure 18:
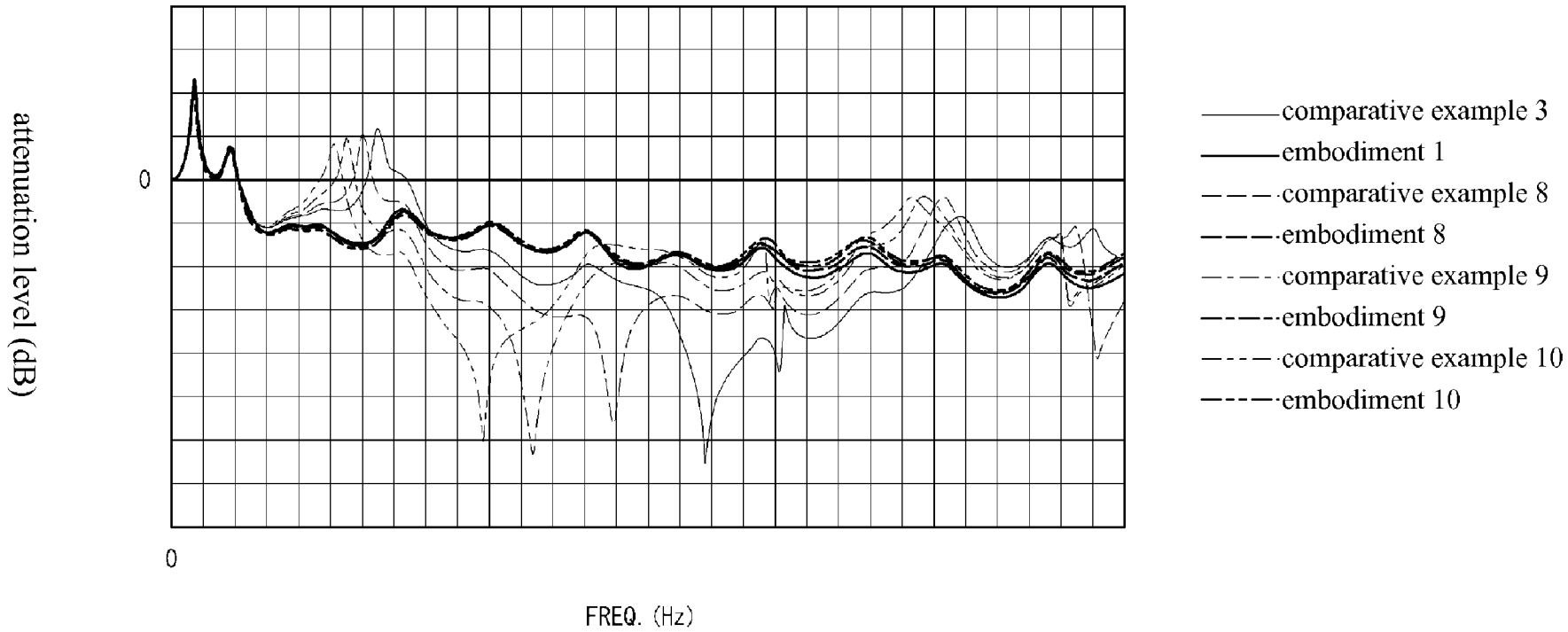
FIG. 18 is a graph showing the effect of silencers according to embodiments 1, 8, 9 and 10 of the present invention on the attenuation characteristics of a muffler.

FIG. 18 is a graph showing the effects of varying the number of through holes as shown in the embodiments of FIGS. 15 to 17. The silencers that are compared in FIG. 18 are comparative example 3, embodiment 1, the structure shown in FIG. 15A (embodiment 8), the structure shown in FIG. 16 (embodiment 9), and the structure shown in FIG. 17 (embodiment 10), all of which have been described above.

From FIG. 18, it can be understood that when the number of the through holes 62*b* positioned in the center is fixed to eight, even if a change is made in the number of the through holes 62*c* positioned in the end portion, the change does not have a large effect on the attenuation characteristics of the silencer.

In FIG. 18, in addition to the constructions shown in the embodiments 8 to 10, attenuation characteristics for corresponding constructions in which their Helmholtz resonators are not packed with the glass wool 72 are also shown as comparative examples 8 to 10. Moreover, the density (apparent density) of the glass wool 72 packed into the Helmholtz resonators in the embodiment 1 and the embodiments 8 to 10 were set equal to each other.

Figure 19B:
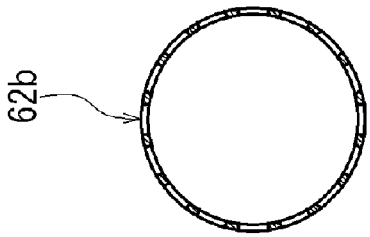
FIG. 19B illustrates a sectional view along a line B-B in FIG. 19A.
Figure 19C:
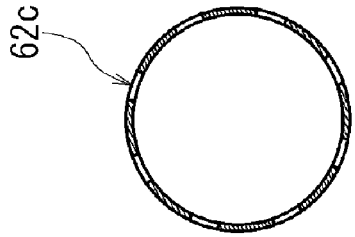
FIG. 19C illustrates a sectional view along a line C-C in FIG. 19A.
Figure 19A:
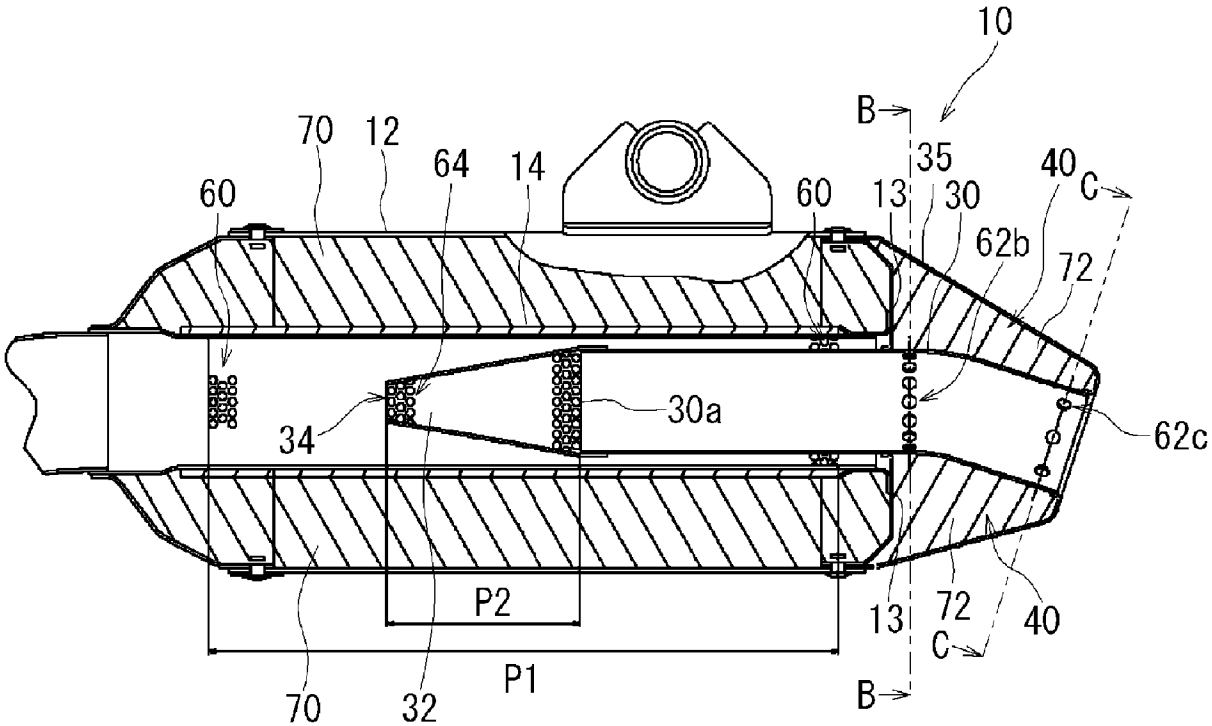
FIG. 19A illustrates a sectional view of a silencer 10 according to embodiment 11 of the present invention.
Figure 20B:
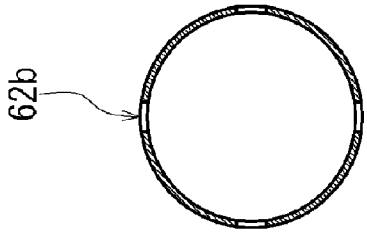
FIG. 20B illustrates a sectional view along a line B-B in FIG. 20A.
Figure 20C:
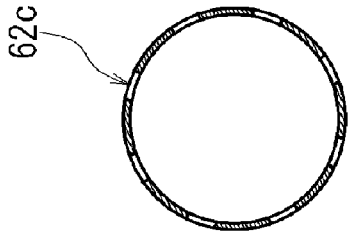
FIG. 20C illustrates a sectional view along a line C-C in FIG. 20A.
Figure 20A:
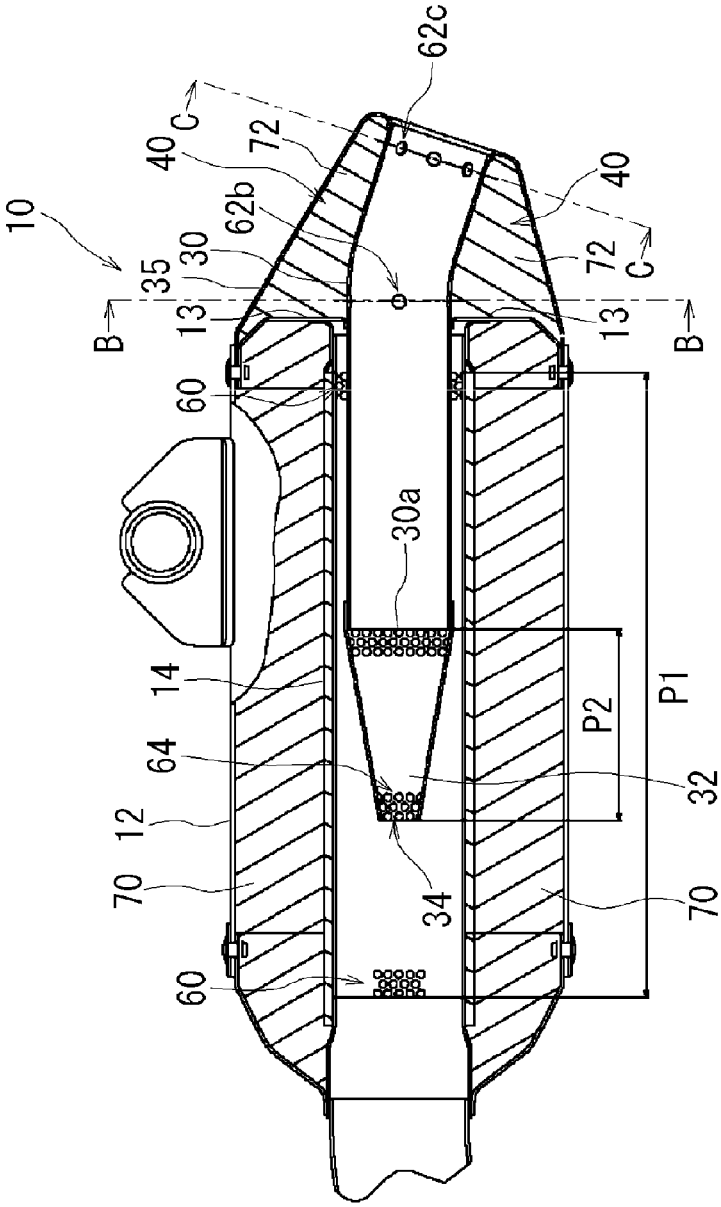
FIG. 20A illustrates a sectional view of a silencer 10 according to embodiment 11 of the present invention.

FIG. 19A and FIG. 20A illustrate longitudinal cross-sectional views of further modified embodiments of the silencer 10 of embodiment 1. FIG. 19B and FIG. 20B, and FIG. 19C and FIG. 20C are sectional views along line B-B and line C-C in FIG. 19A and FIG. 20A, respectively.

In the constructions shown in FIG. 19 and FIG. 20, the number of the through holes 62*b* in the central portion is different from the number of the through holes 62*c* on the downstream side (or opening end side). The diameters of the through holes 62*b* and 62*c* shown in FIG. 19 and FIG. 20 are equal to each other. The number of the through holes 62*b* shown in FIG. 19 is sixteen, whereas the number of the through holes 62*c* is eight. The number of the through holes 62*b* shown in FIG. 20 is four, whereas the number of the through holes 62*c* is eight.

In the modified embodiment shown in FIG. 19, the number of the through holes 62*b* in the central portion is larger than the number of the through holes 62*c* on the downstream side (or opening end side). On the other hand, in the modified embodiment shown in FIG. 20, the number of the through holes 62*b* in the central portion is smaller than the number of the through holes 62*c* on the downstream side (or opening end side). Here, the number of the through holes 62*c* is fixed (e.g., to eight) whereas the number of the through holes 62*b* is changed.

Figure 21:
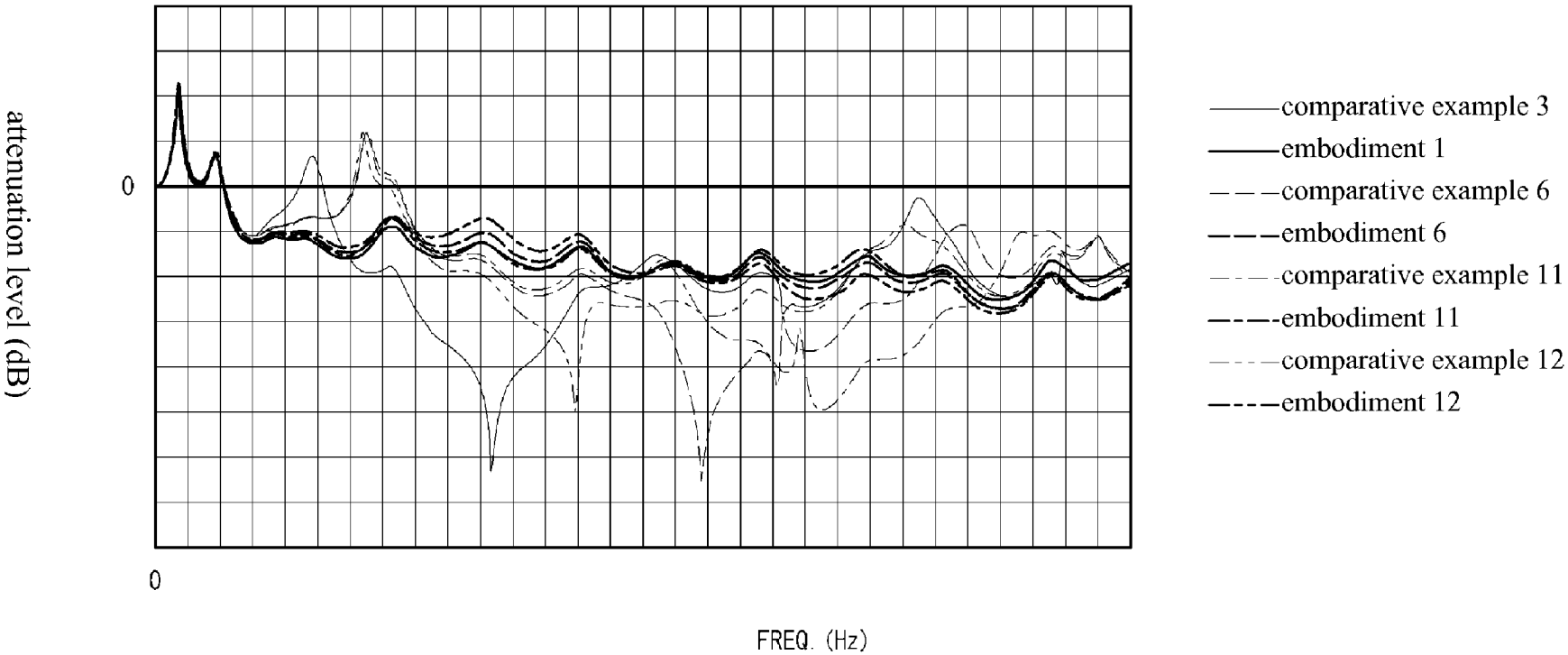
FIG. 21 is a graph showing the effect of silencers according to embodiments 1, 6, 11, and 12 of the present invention on the attenuation characteristics of a muffler.

FIG. 21 is a graph showing the effects of the structures shown in FIG. 19 and FIG. 20. The silencers compared in the graph in FIG. 21 are comparative example 3, embodiment 1, embodiment 6, comparative example 6, the structure shown in FIG. 19 (embodiment 11), and the structure shown in FIG. 20 (embodiment 12).

From FIG. 21, it can be understood that the attenuation characteristics can be changed by changing the number of through holes 62*b* positioned in the center. In other words, a change in the collective area of the through holes 62*b* positioned in the central portion makes a larger effect on the attenuation characteristics than a change in the collective area of the through holes 62*c* positioned in the end portion, so that the change in the collective area of the through holes 62*b* positioned in the central portion can change the attenuation characteristics.

In addition to the constructions of embodiment 11 and embodiment 12, attenuation level curves for corresponding constructions in which the Helmholtz resonators 40 are not packed with the glass wool 72 are also shown as comparative examples 11 and 12. Here, the density (apparent density) of the glass wool 72 packed into the Helmholtz resonators 40 of the embodiment 1, embodiment 11, and embodiment 12 were set equal to each other.

Side Branch Resonator Embodiments

The construction and the effect of a silencer 10 according to various side branch resonator embodiments of the present invention will now be described with reference to FIG. 22 to FIG. 25. In embodiments 1-12 described above, the embodiments all have a silencer 10 mounted with a Helmholtz resonator 40, whereas all of the embodiments 13-19 described below all have a silencer 10 having a side branch resonator 45.

Figure 22B:
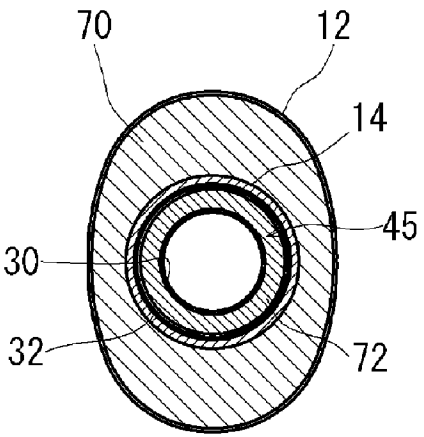
FIG. 22B illustrates a sectional view along a line B-B in FIG. 22A.
Figure 22A:
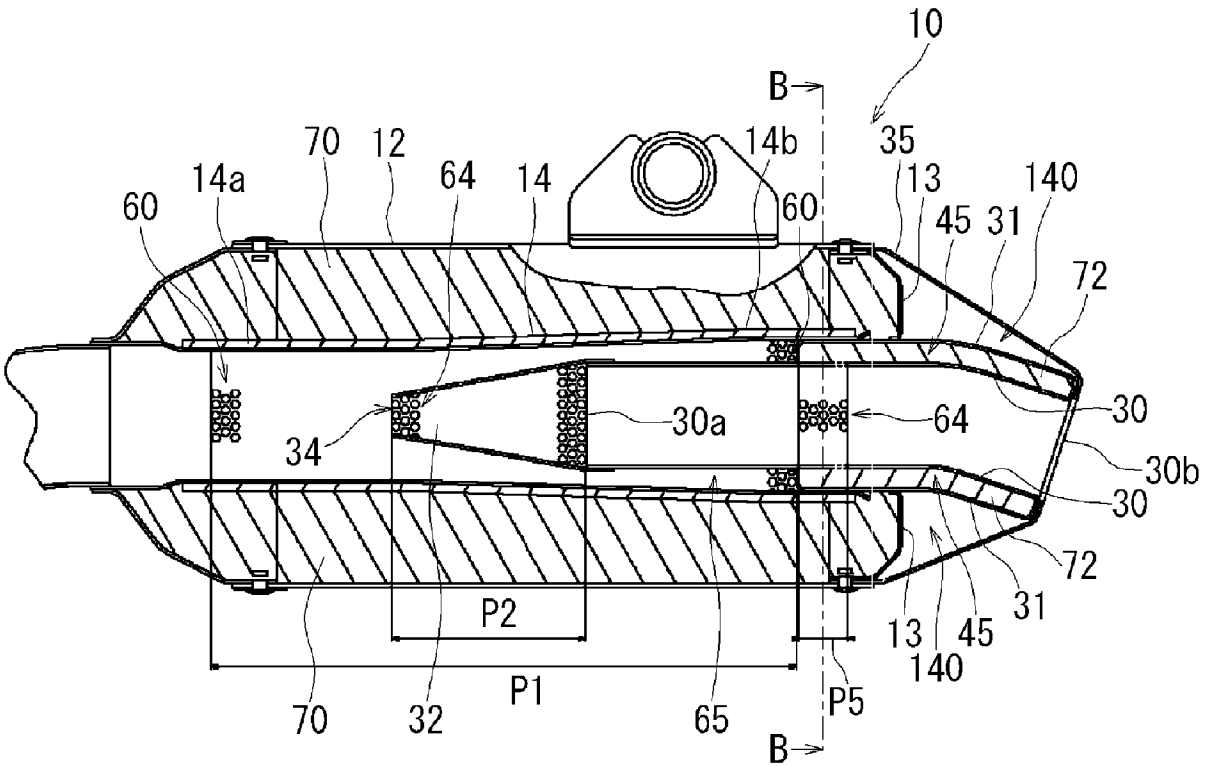
FIG. 22A illustrates a sectional view of a silencer 10 according to embodiment 13 of the present invention.

FIG. 22A is a longitudinal cross-sectional view of a silencer 10 mounted with a side branch resonator 45, and FIG. 22B is a sectional view along line B-B in FIG. 22A.

The silencer 10 shown in FIG. 22 has a tail pipe 30 arranged in the rear portion thereof, and the tail pipe 30 has a side branch pipe 31 formed on the outer periphery of the tail pipe 30. Moreover, the tail pipe 30 and the side branch pipe 31, which are positioned at the rear portion of the silencer 10, are covered by the tail cap 35.

In the construction of this embodiment (embodiment 13), the side branch resonator 45 is formed by the tail pipe 30 and the side branch pipe 31. In this embodiment, the cross-sectional area of the side branch resonator 45 is nearly equal to the cross-sectional area of the interior of the tail pipe 30. By making the cross-sectional areas of both parts nearly equal to each other, the sound energy of the tail pipe 30 can be easily taken into the side branch resonator 45. Moreover, the tail pipe 30 has slits 64, which can be openings formed by punching, formed in a region P5 thereof, allowing the tail pipe 30 to be connected to the side branch resonator 45. In this embodiment, the tail pipe 30 has the slits 64 formed in the central portion thereof, and the total area formed by the slits 64 is made nearly equal to the cross-sectional area of the side branch resonator 45. Here, a hollow space 140 defined by the side branch pipe 31, partition plate 13, and tail cap 35 surrounds the rear portion of the tail pipe 30 and side branch pipe 31, but does not communicate with the tail pipe 30 or side branch pipe 31.

In the embodiment shown in FIG. 22, the side branch resonator 45 is formed by the tail pipe 30 and the side branch pipe 31, so that the length l of the side branch shown in FIG. 4 is derived depending on the length of the side branch resonator 45.

Moreover, the inner cylinder 14 of this embodiment is constructed in such a way that the diameter of the inner cylinder 14 becomes larger toward the downstream side 14*b* from the upstream side 14*a*. In addition, a clearance air layer 65 is interposed between the inner cylinder 14 and the tail pipe 30.

Figure 23B:
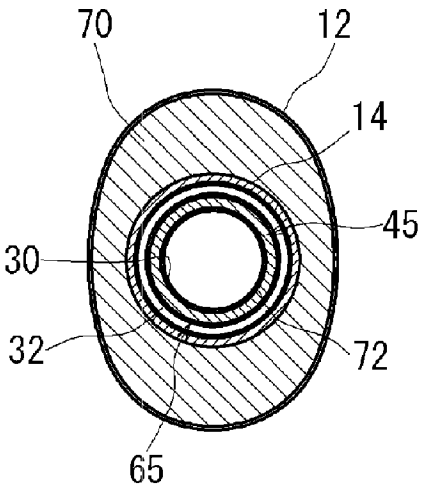
FIG. 23B illustrates a sectional view along a line B-B in FIG. 23A.
Figure 23A:
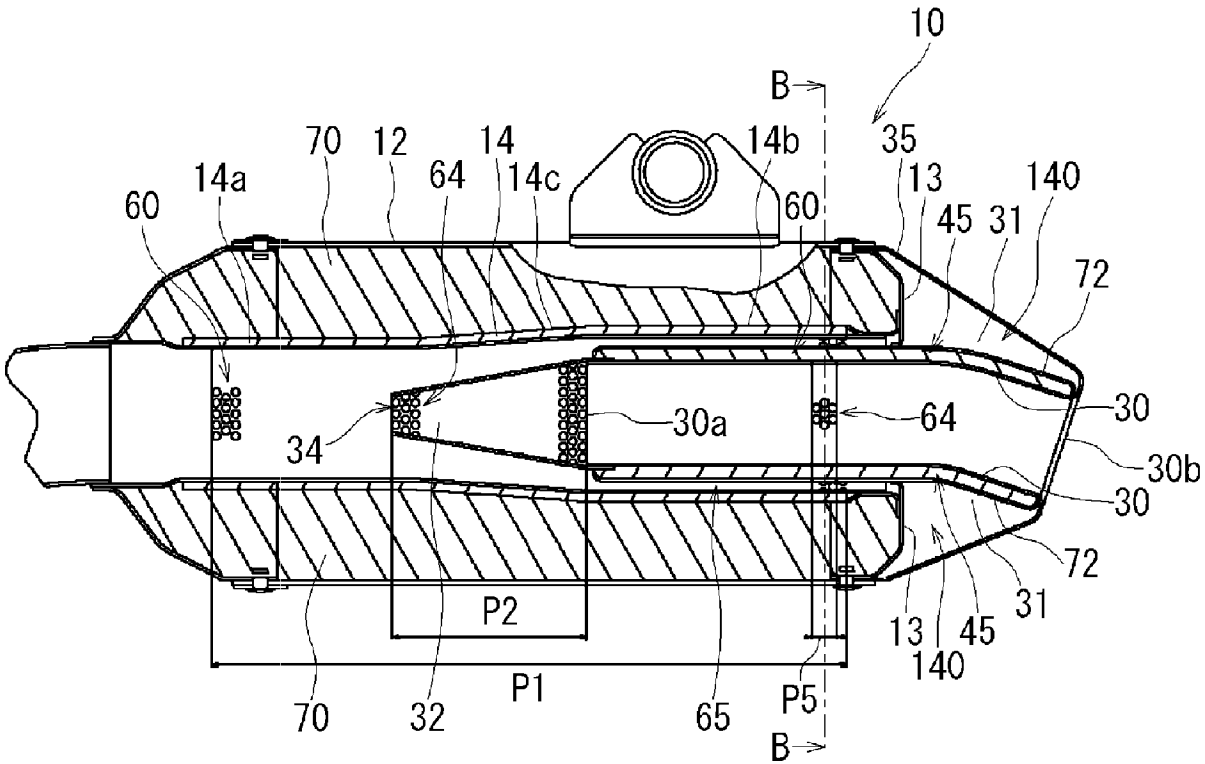
FIG. 23A illustrates a sectional view of a silencer 10 according to embodiment 14 of the present invention.

FIG. 23A illustrates a longitudinal cross-sectional view of a modified embodiment of the silencer 10 of embodiment 13 of FIG. 22, and FIG. 23B is a view along line B-B in FIG. 23A.

The modified embodiment (embodiment 14) shown in FIG. 23 is constructed in such a way that the length of the side branch resonator 45 is longer than that in embodiment 13 shown in FIG. 22. In this modified embodiment, the tail pipe 30 and the side branch pipe 31 are made equal to each other in length. In this modified embodiment, the cross-sectional area of the side branch resonator 45 is made nearly half of the cross-sectional area of the interior of the tail pipe 30. Moreover, the tail pipe 30 has slits 64 formed in the central portion thereof and the length of the side branch resonator 45 is made equal to the length of the tail pipe 30, so that this modified embodiment 14 has a structure intended for producing the effect of two side branch resonators.

Moreover, the inner cylinder 14 of the modified embodiment shown in FIG. 23 has a tapered portion 14*c* formed between the upstream side 14*a* and the downstream side 14*b*. Thus, the inner cylinder 14 is constructed in such a way that the diameter thereof becomes larger toward the downstream side 14*b* from the upstream side 14*a*.

Figure 24:
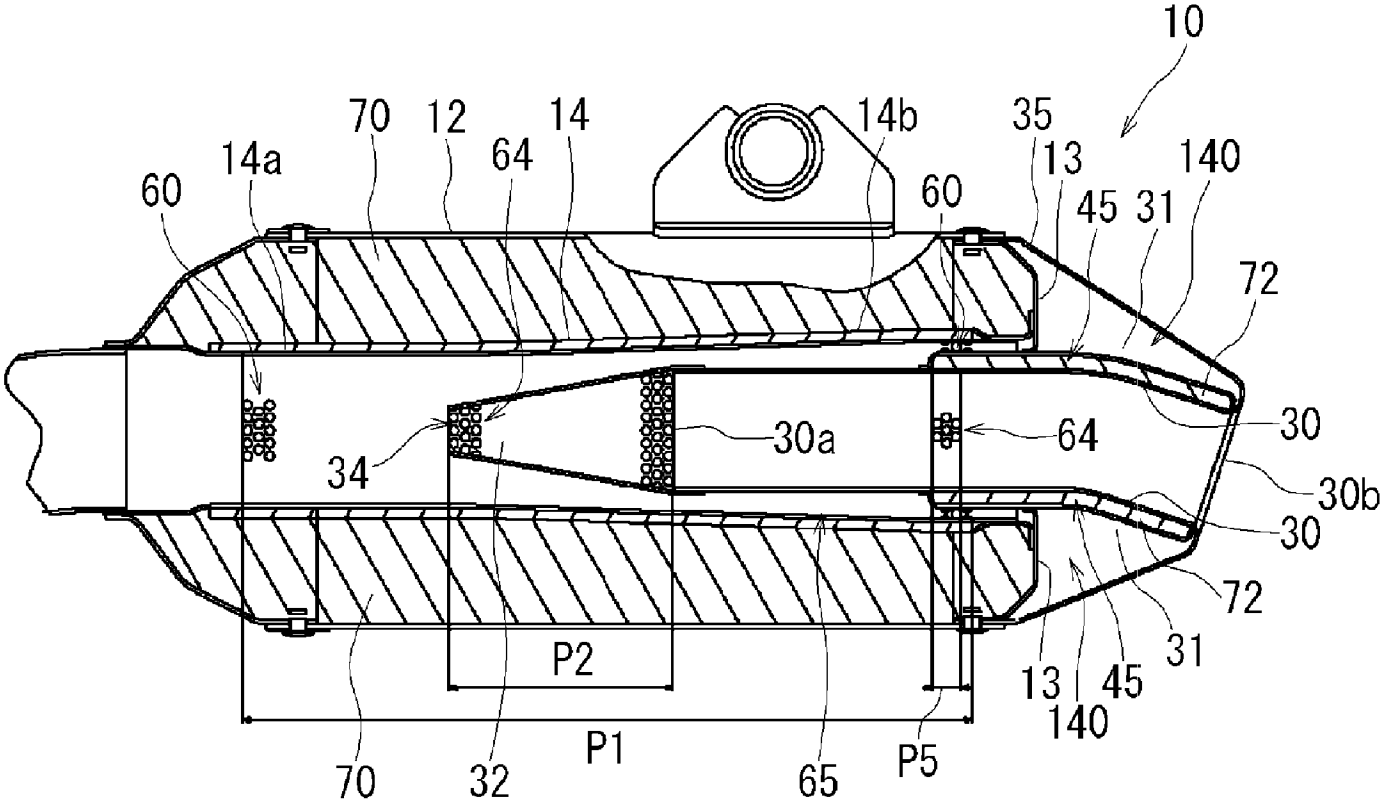
FIG. 24 illustrates a sectional view of a silencer 10 according to embodiment 15 of the present invention.

FIG. 24 is a longitudinal cross-sectional view of a modified embodiment of the silencer 10 of embodiment 13 of FIG. 22. The modified embodiment (embodiment 15) shown in FIG. 24 is constructed in such a way that the length of the side branch resonator 45 is made shorter than that in the modified embodiment 14 shown in FIG. 23. In this modified embodiment, the cross-sectional area of the side branch resonator 45 is made nearly half of the cross-sectional area of the tail pipe 30. Moreover, the tail pipe 30 has the slits 64 formed in the central portion thereof and the length of the side branch resonator 45 is made nearly half of the length of the tail pipe 30. Thus, this modified embodiment 15 has a structure intended for producing the effect of one side branch resonator.

The three embodiments shown in FIG. 22 to FIG. 24 are different from each other in their attenuation characteristics. Thus, a structure to satisfy the attenuation characteristics required under various restriction conditions can be employed. Here, in some cases, the side branch resonator 45 shown in FIG. 22 and FIG. 24 is disposed on the downstream side, not on the upstream side.

Now, the effect of silencers 10 having a side branch resonator 45 according to embodiments 13 to 15 will be described with reference to FIG. 25. The silencers compared in FIG. 25 include embodiment 13 shown in FIG. 22, embodiment 14 shown in FIG. 23, embodiment 15 shown in FIG. 24, and comparative example 2 shown in FIG. 8. The diameter, thickness, and length of the tail pipe 30 shown in FIG. 8 are the same as those of the embodiment 13 shown in FIG. 22.

In addition to the constructions shown in the embodiments 13 to 15, attenuation level curves for corresponding constructions in which the side branch resonators 45 were not packed with the glass wool 72 are also included as comparative examples 13 to 15. The density (apparent density) of the glass wool 72 packed into the side branches 45 in the embodiments 13 to 15 were set equal to each other.

Just as with the above-described Helmholtz embodiments, it can be seen that the attenuation characteristics of silencers (e.g., embodiments 13 to 15) having a side branch resonator 45 according to the present invention are better than those of the comparative example 2 and the comparative examples 13 to 15. First, when the embodiments 13 to 15 of Embodiment 2 are compared with the comparative example 2, it can be seen that the attenuation level (dB) at frequency f(E) is lower. Moreover, it can be seen that the attenuation characteristics of the construction of the side branch resonator embodiments (such as embodiments 13 to 15) are generally better than those of the comparative example 2 even at other frequencies.

Figure 25:
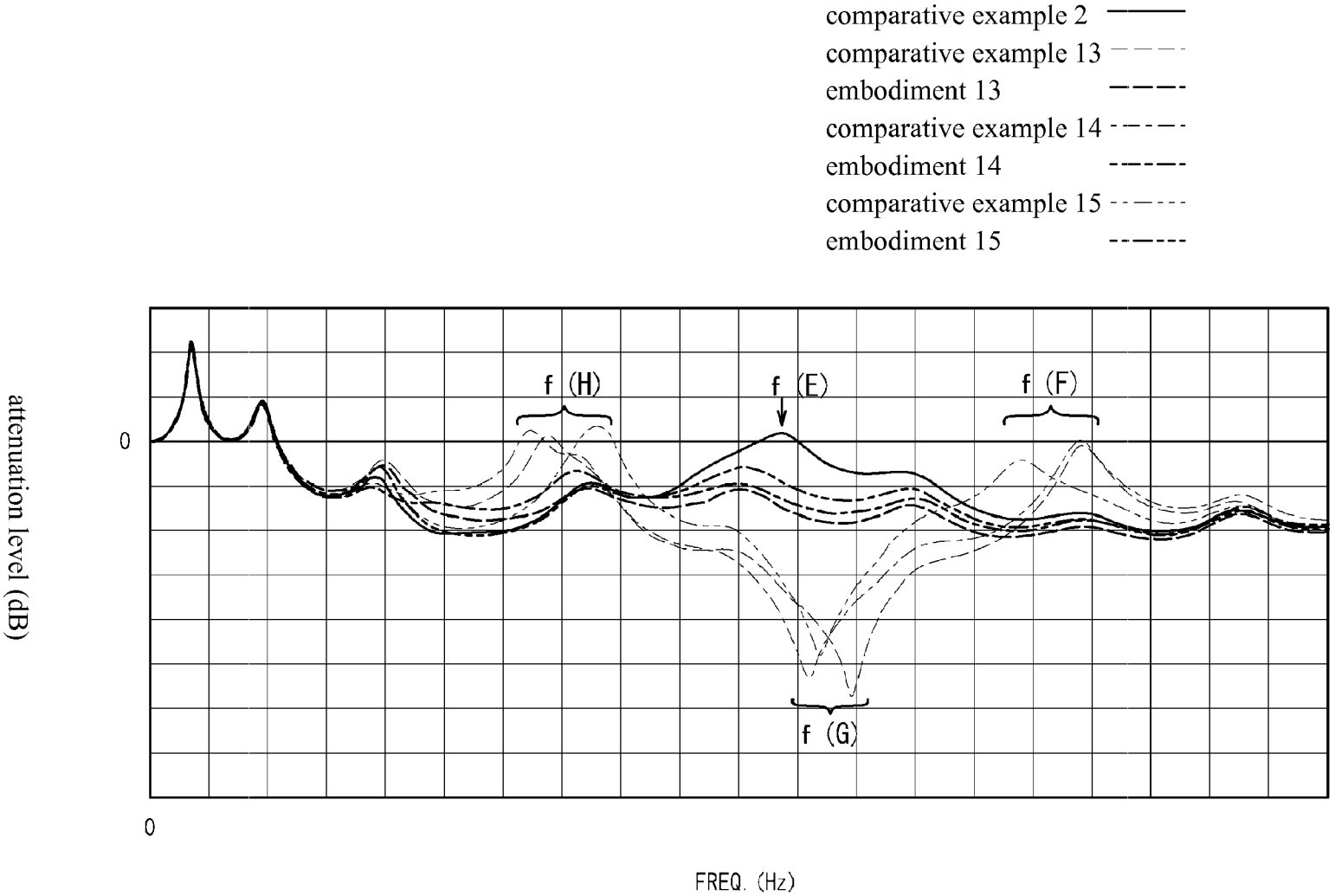
FIG. 25 is a graph showing the effect of silencers according to embodiments 13, 14, and 15 of the present invention on the attenuation characteristics of a muffler.

As shown in FIG. 25, comparative examples 13 to 15, which have side branch resonators 45 that are not packed with a sound absorbing material, can greatly reduce the attenuation level of a frequency band f(G) as compared with the comparative example 2, which has a Helmholtz resonator instead of a side branch resonator 45. However, in the comparative examples 13 to 15, new peaks of the attenuation level are developed at a frequency f(H) and a frequency f(F), which results in impairing the overall attenuation characteristics of the silencers. On the other hand, the embodiments 13 to 15 according to the present invention prevent the new peaks of the attenuation level from being developed and hence can produce much better attenuation characteristics than the comparative examples 13 to 15.

Figure 26:
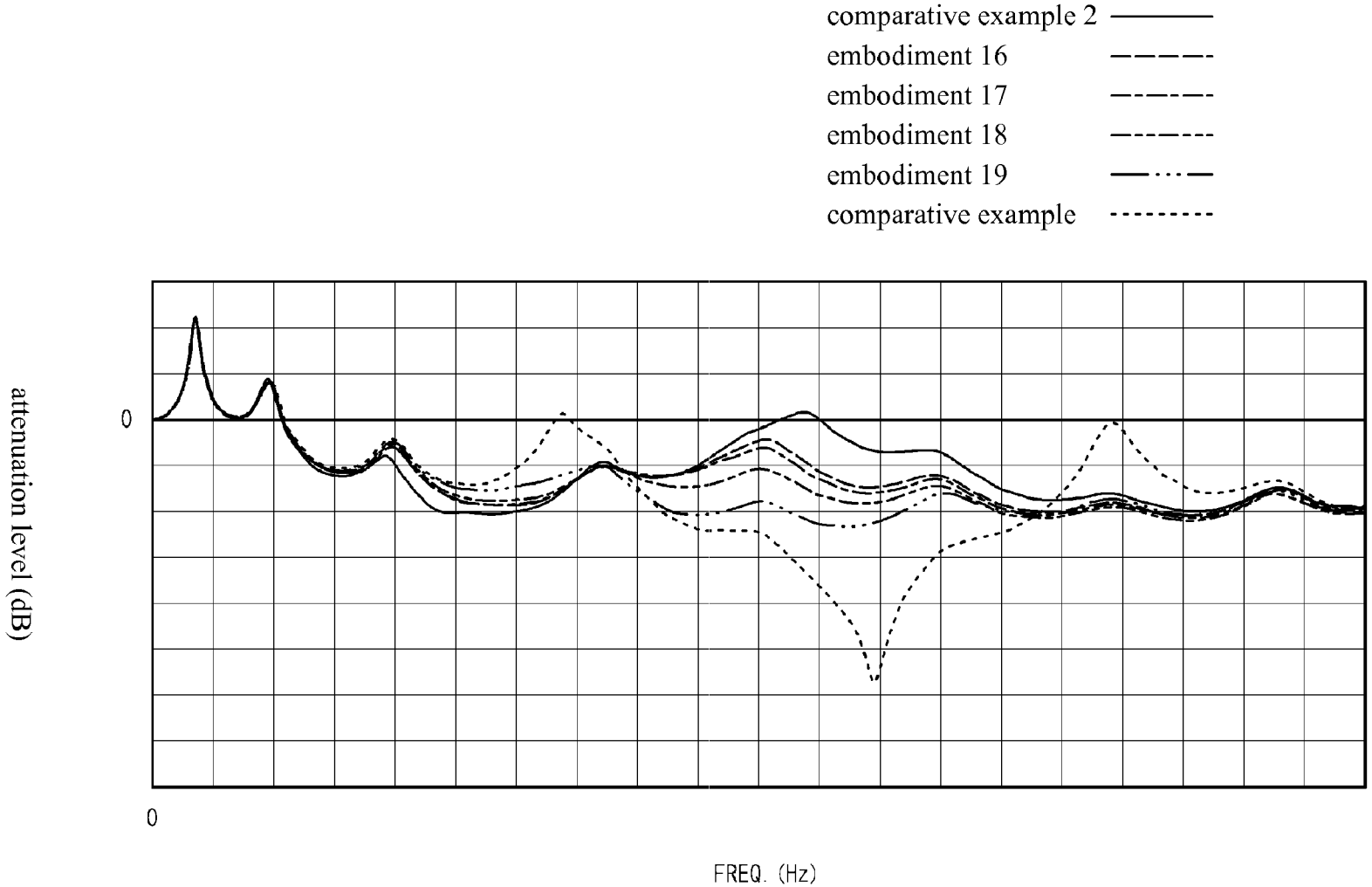
FIG. 26 is a graph showing the effect of silencers according to embodiments 16, 17, 18, and 19 of the present invention on the attenuation characteristics of a muffler.

FIG. 26 shows the result when the density (apparent density) of the sound absorbing material (e.g., glass wool) 72 packed into the side branch resonator 45 is changed. The comparative example 2 and the comparative example 13 have been described above. The comparative example 2 has a Helmholtz resonator 40 formed therein instead of the side branch resonator 45 formed therein, and the comparative example 13 is similar to the embodiment 13 but does not have glass wool 72 packed in the side branch resonator 45. In other words, the density of the glass wool 72 is, 0 kg/m$^3$. Embodiments 16 to 19 are embodiments in which the density of the glass wool 72 is set at three, two, one, and ½ times, respectively, the density of the glass wool 72 used in embodiment 13. Consequently embodiment 18 is identical to embodiment 13.

As shown in FIG. 26, the side branch resonator 45 according to the present invention (such as embodiments 16 to 19) can reduce the attenuation level as compared with the comparative example 2 not having the side branch resonator 45. In addition, embodiments 16 to 19 prevent a new peak of the attenuation level from being developed and thus show better attenuation characteristics overall than the comparative example 13, having a side branch resonator 45 that is not packed with the sound absorbing material (that is, the apparent density of the sound absorbing material is 0 kg/m$^3$).

Figure 27B:
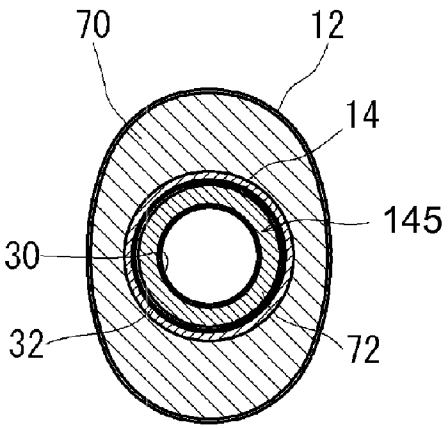
FIG. 27B illustrates a sectional view along a line B-B in FIG. 27A.
Figure 27A:
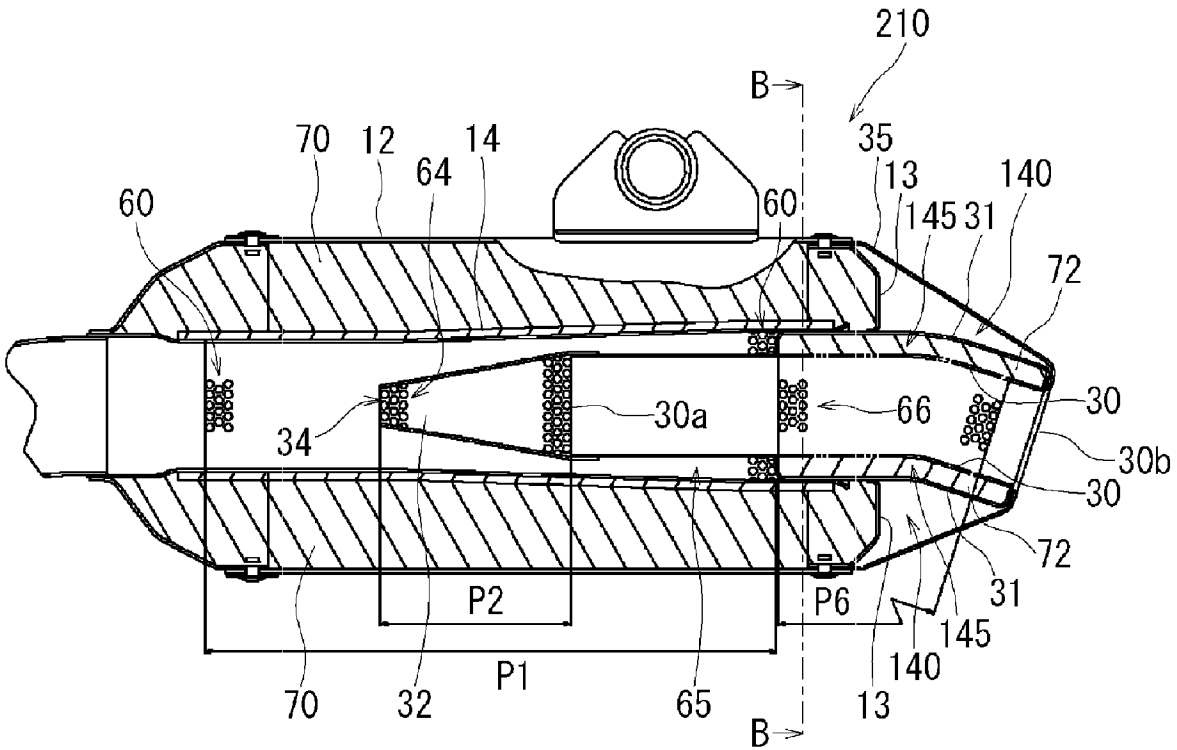
FIG. 27A illustrates a sectional view of a silencer 210 of a comparative example.

FIG. 27A illustrates a longitudinal cross-sectional view of comparative example 210 and FIG. 27B is a sectional view along line B-B in FIG. 27A. The comparative example 210 shown in FIG. 27A is characterized by having punched holes 66 formed in a region P6 of the tail pipe 30 and by having the tail pipe 30 connected to a space 145 through the punched holes 66. The punched holes 66 are arranged in the entire region. In the case of this example, the punched holes 66 are formed in the entire region covered by the pipe 31. As a result, the space 145 does not behave as the above-described side branch resonator 45, which becomes the resonator, but is only a space. However, to compare the space 145 with the side branch resonator 45, the space 145 is packed with the sound absorbing material 72.

Here, the diameter, thickness, and length of the tail pipe 30 shown in FIG. 27 are equal to those of the embodiment shown in FIG. 22.

Figure 28:
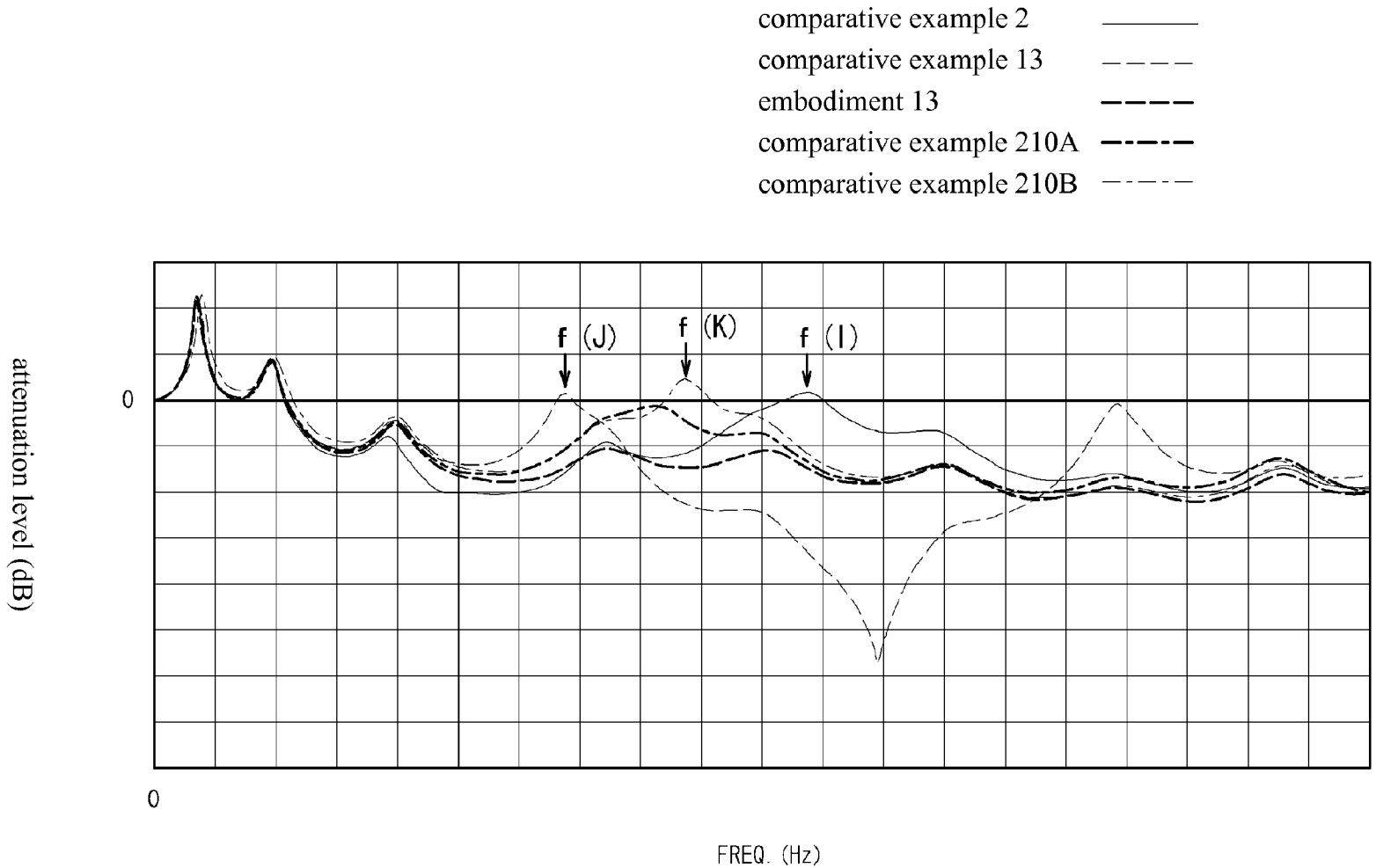
FIG. 28 is a graph showing the effect of a silencer with a side branch resonator according to the present invention on the attenuation characteristics of a muffler.

FIG. 28 shows the effect of the silencer 210 shown in FIG. 27. The silencers compared in FIG. 28 are comparative example 2, comparative example 13, embodiment 13, and the structure shown in FIG. 27 (comparative example 210A), all of which have been described above. Moreover, in addition to these, an attenuation curve for a structure in which the space 145 shown in FIG. 27 is not packed with the sound absorbing material 72 is also expressed as a comparative example 210B. Here, the density (apparent density) of the glass wool 72 in the embodiment 13 is equal to the density (apparent density) of the glass wool 72 packed into the space 145 in the comparative example 210A.

As shown in FIG. 28, it can be found that the comparative example 210A shown in FIG. 27 has worse attenuation characteristics than embodiment 13. Moreover, it can be found that the attenuation characteristics of the comparative examples 13 and 210B are also worse.

According to the construction of the side branch resonator embodiments of the present invention, the silencer 10 is provided with the side branch resonator 45, and the side branch resonator 45 is packed with the sound absorbing material 72. Thus, the attenuation characteristics can be enhanced by the side branch resonator 45, and the peak of an attenuation level at a resonance frequency, which is newly developed by the side branch resonator 45, can be decreased by packing the side branch resonator 45 with the sound absorbing material 72. As a result, even when the volume of the silencer cannot be increased so as to prevent an increase in the weight of the muffler, the effect of deadening sound can be enhanced. Moreover, according to the construction of this embodiment, at least a portion of the side branch resonator 45 is formed in the tail cap 35, which can prevent the volume of the silencer from being increased more than required. However, even when the tail cap 35 cannot be used as the resonator or the tail cap 35 is not provided, the side branch resonator 45 can be formed with comparative ease. The side branch resonator embodiments also have technical merit on this point.

Additional Helmholtz Resonator Embodiments

Figure 29B:
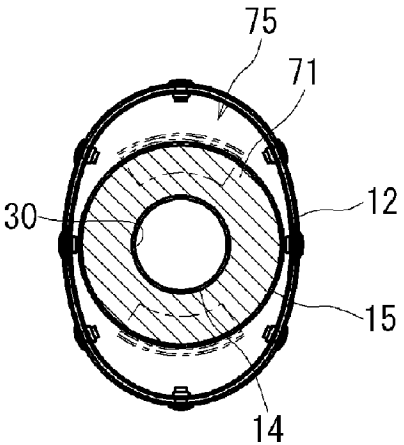
FIG. 29B illustrates a sectional view along a line B-B in FIG. 29A.
Figure 29C:
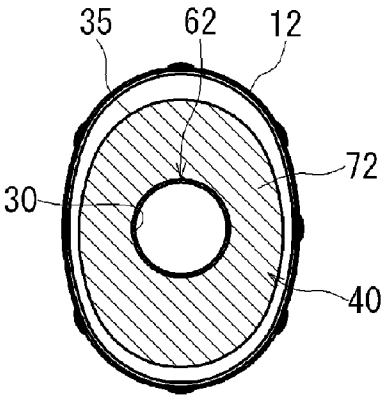
FIG. 29C illustrates a sectional view along a line C-C in FIG. 29A.
Figure 29A:
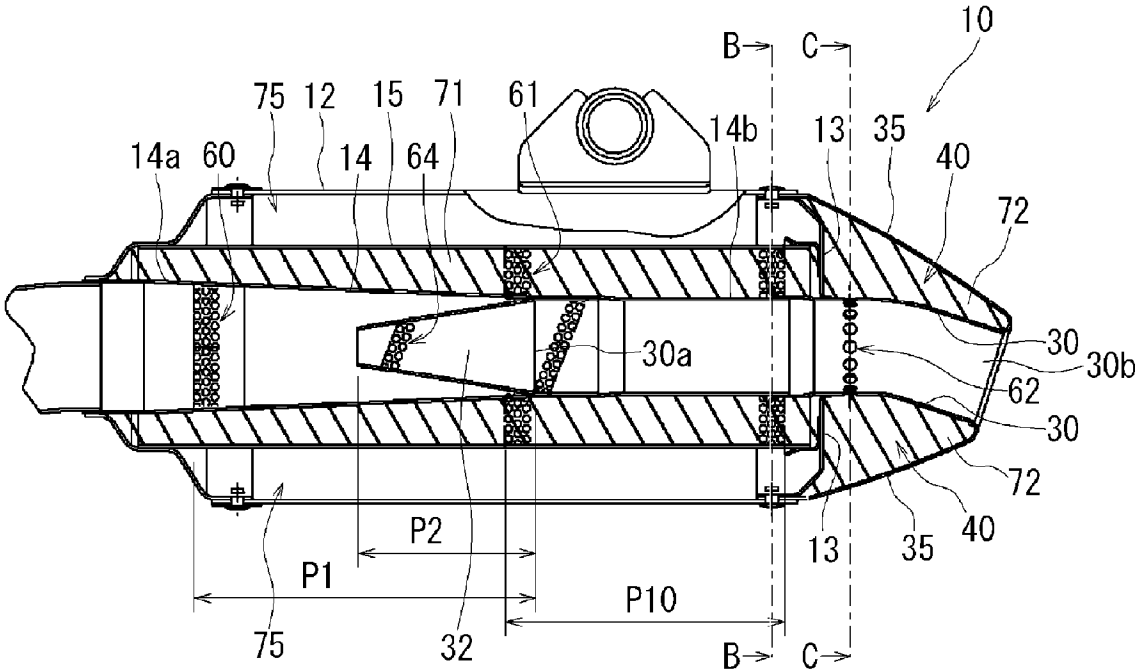
FIG. 29A illustrates a sectional view of a silencer 10 according to embodiment 20 of the present invention.

Now, additional Helmholtz resonator embodiments 20-23 according to the present invention will be described. FIG. 29A is a longitudinal cross-sectional view of a modified embodiment (embodiment 20) of a silencer 10 of the present invention, and FIGS. 29B and 29C are sectional views along line B-B and line C-C in FIG. 29, respectively.

The silencer 10 shown in FIG. 29 is basically the same as the construction shown in FIG. 5 and has a Helmholtz resonator 40 formed in the tail cap 35. However, in the construction shown in FIG. 29, a middle cylinder 15 is interposed between the inner cylinder 14 and the outer cylinder 12. A space between the inner cylinder 14 and the middle cylinder 15 is packed with a sound absorbing material 71 made of SUS wool, and a space between the middle cylinder 15 and the outer cylinder 12 comprises an air layer 75. The middle cylinder 15 has punched holes 61 formed in a region P10 thereof. Moreover, the inner cylinder 14 of this modified embodiment has a construction in which the diameter becomes smaller from the upstream side 14*a* to the downstream side 14*b*.

The Helmholtz resonator 40 of this embodiment (embodiment 20), has the same construction as the construction shown in FIG. 5. The Helmholtz resonator 40 is packed with the glass wool 72. The sixteen through holes 62 connecting the tail pipe 30 and the Helmholtz resonator 40 are circular in shape.

Figure 30:
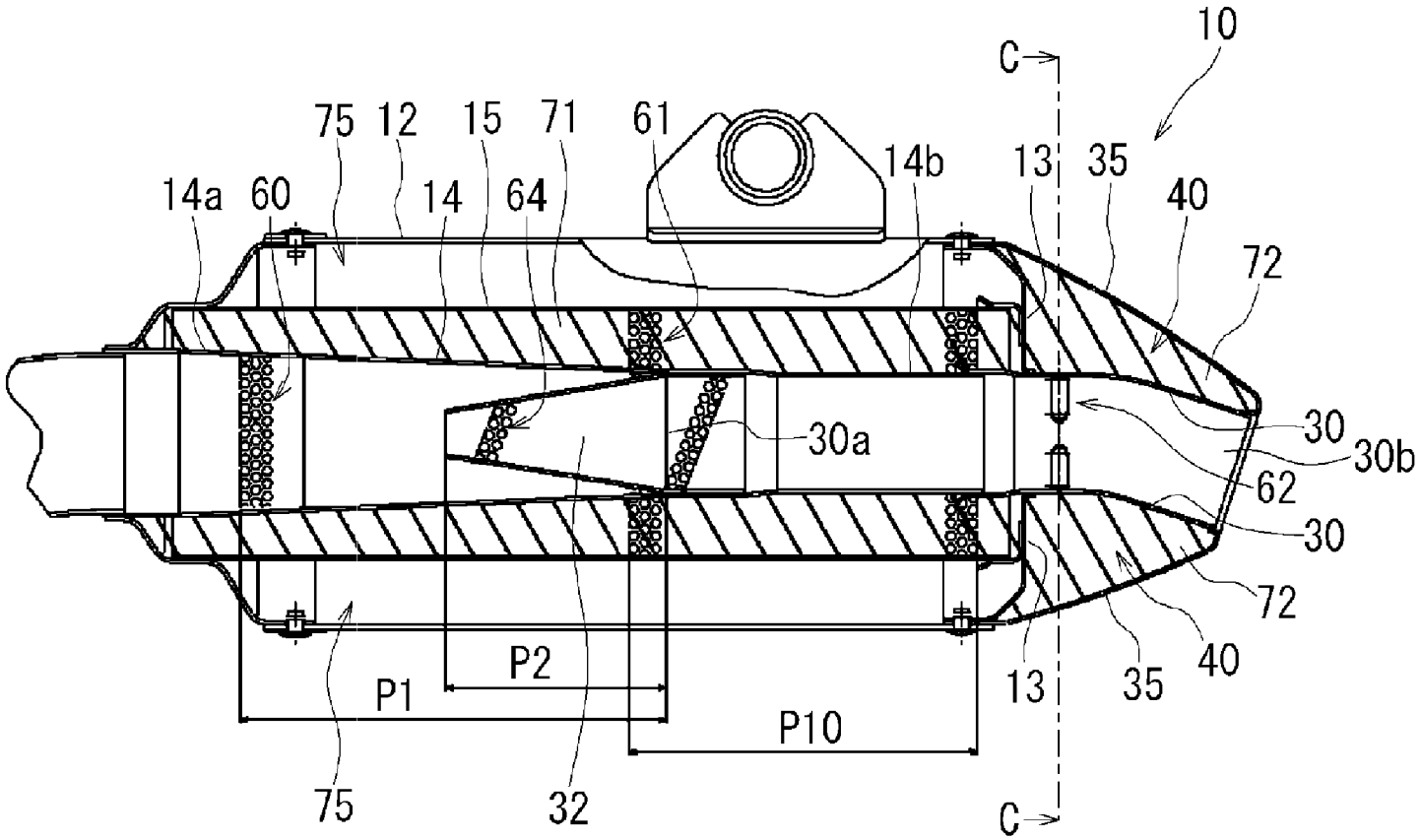
FIG. 30 illustrates a sectional view of a silencer 10 according to embodiment 21 of the present invention.
Figure 31A:
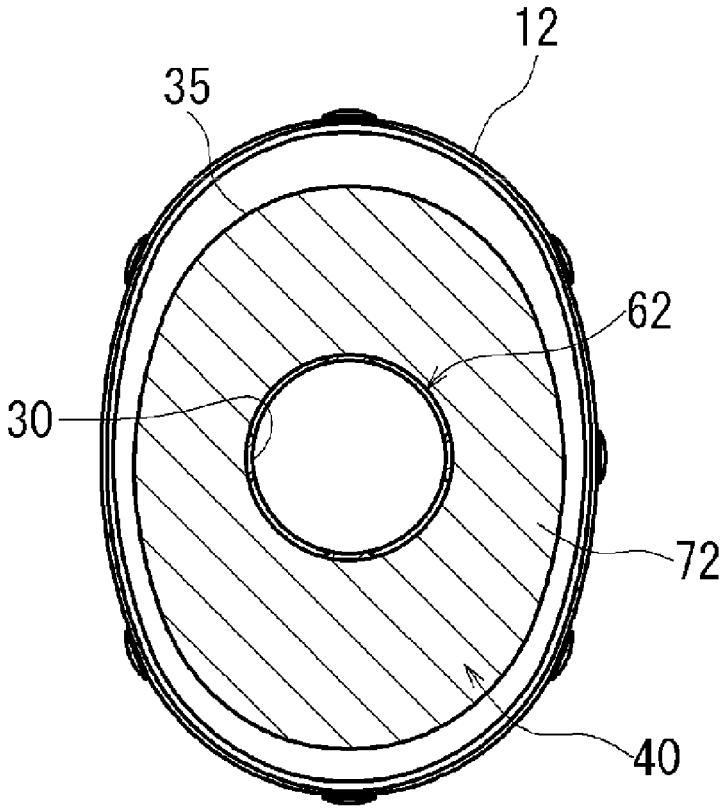
FIG. 31A illustrates a sectional view along a line C-C in FIG. 30.
Figure 31B:
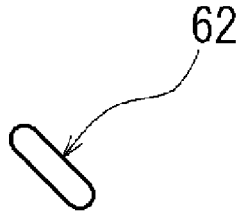
FIG. 31B illustrates a diagram to show the shape of a through hole 62.

FIG. 30 shows a modified embodiment (embodiment 21) of the silencer 10 shown in FIG. 29. The silencer 10 shown in FIG. 30 is different from the silencer 10 shown in FIG. 29 because the through holes 62 are ellipsoidal or nearly ellipsoidal, instead of circular. FIG. 31A illustrates a sectional view along line C-C in FIG. 30, and FIG. 31B shows the shape of the through hole 62. Even in the case of the ellipsoidal shape, a change in the area of the opening has an effect on the attenuation characteristics. Moreover, as shown, the shape of the neck of the tail pipe 30 may not only be formed by an integral pipe member but may also be formed by coupling divided pipe members. Here, as for the ellipsoidal shape of the through hole 62, its shape and size can be changed as appropriate.

Figure 32:
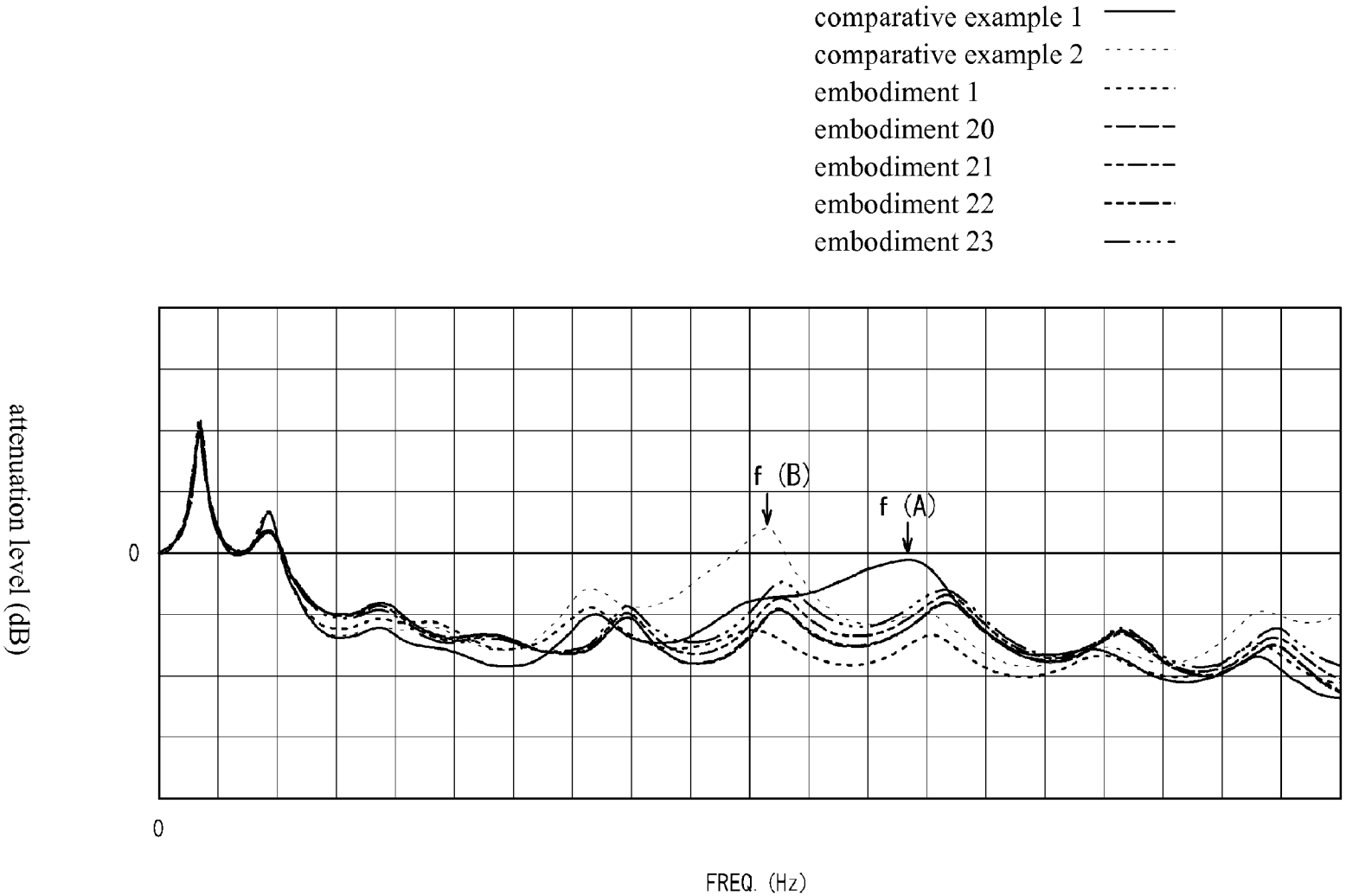
FIG. 32 is a graph to showing the effect of silencers according to a another Helmholtz resonator embodiment of the present invention on the attenuation characteristics of a muffler.

FIG. 32 shows the effect of the silencer 10 according to the embodiments 20 and 21. The silencers compared in FIG. 32 are comparative example 1, comparative example 2, embodiment 1, embodiment 20 shown in FIG. 29, and embodiment 21 shown in FIG. 30, all of which have been described above. In addition, an embodiment 22 and embodiment 23 are also compared in FIG. 32. Embodiment 22 and embodiment 23 are identical to embodiment 21 except the shape of their ellipsoidal through holes 62 has been varied. Embodiment 22 and embodiment 23 have ellipsoidal through holes 62 that are equal in width to embodiment 21 however, the length of the ellipsoidal through holes 62 in embodiment 23 is shorter than the length of the ellipsoidal shape of the through hole 62 in embodiment 22. For the sake of comparison, the density (apparent density) of the glass wool 72 packed into the Helmholtz resonators 40 of embodiment 1 and embodiments 20 to 23 were set equal to each other.

From FIG. 32, it can be seen that the construction of embodiments 20 to 23 can show better attenuation characteristics than the comparative example 1 and comparative example 2.

In FIG. 1, an off-road motorcycle has been shown as an example of a motorcycle 1000. However, the motorcycle 1000 may be an on-road motorcycle. Moreover, a "motorcycle" in the specification of this application includes a motor bicycle (motorbike) and a scooter and, specifically, means a vehicle designed to turn with its vehicle body frame inclined. Thus, even if a vehicle has two or more wheels as at least one of the front wheel and the rear wheel and hence becomes a three-wheeled vehicle or a four-wheeled vehicle (or four-or-more wheeled vehicle) in terms of the number of tires, the vehicle can be included in the term "motorcycle". For example, here, the present invention can be applied not only to the conventional motorcycle but also to other vehicles that can utilize the effect of the present invention. For example, in addition to the conventional motorcycle, the present invention can be applied to a so-called straddle-type vehicle including a four-wheel buggy (ATV: All Terrain Vehicle) and a snowmobile.

According to the present invention, it is thus possible to provide a muffler for a straddle-type vehicle that satisfies the requirements of sound deadening and which has reduced size.

Up to this point, the present invention has been described by describing preferred embodiments. However, the description of those preferred embodiments does not limit the present invention, as the present invention can be variously modified as one skilled in the art will appreciate from the foregoing description.

What is claimed is:

1. An exhaust device for a straddle-type vehicle, the exhaust device comprising:

an exhaust pipe configured to be connected to an engine; and a silencer connected to the exhaust pipe, wherein the silencer includes at least one resonator selected from a group consisting of a Helmholtz resonator and a side branch resonator, the resonator being packed with a sound absorbing material, such that the sound absorbing material fills an interior volume of the resonator, the Helmholtz resonator includes a resonance frequency adjusted by a diameter and a length of a neck portion and a volume of a hollow portion of the Helmholtz resonator, and the side branch resonator includes a resonance frequency adjusted by a length of the side branch resonator and a number of side branches in the side branch resonator.

2. The exhaust device as claimed in claim 1, wherein the silencer has a tail pipe arranged in a rear portion thereof, the tail pipe being covered by a tail cap, the tail cap including the resonator arranged therein.

3. The exhaust device as claimed in claim 1, wherein the sound absorbing material comprises glass wool.

4. The exhaust device as claimed in claim 1, wherein the sound absorbing material comprises stainless wool.

5. The exhaust device as claimed in claim 1, wherein the sound absorbing material reduces a peak of an attenuation level at a resonance frequency caused by the resonator.

6. A straddle-type vehicle comprising the exhaust device as claimed in any one of claims 1 to 4.

7. The straddle-type vehicle as claimed in claim 5, wherein the straddle-type vehicle includes a four-cycle engine.

8. A silencer device of an internal combustion engine, the silencer comprising:

an outer cylinder;

an inner cylinder including an exhaust inlet side and an exhaust outlet side, the inner cylinder being longitudinally disposed within the outer cylinder;

a first space between the inner cylinder and outer cylinder in gas communication with the inner cylinder, the first space being filled with a sound absorbing material;

a partition plate connecting a downstream end of the inner cylinder to a downstream end of the outer cylinder and enclosing a downstream end of the first space;

a tail pipe, the tail pipe operatively disposed within the inner cylinder so that an upstream end of the tail pipe is located between the upstream end of the inner cylinder and the downstream end of the inner cylinder and a downstream end of the tail pipe extends past the downstream end of the inner cylinder;

a resonator in gas communication with the tail pipe; and the resonator being filled with a sound absorbing material; wherein the resonator is at least one resonator selected from the group consisting of a Helmholtz resonator and a side branch resonator;

the Helmholtz resonator includes a resonance frequency adjusted by a diameter and a length of a neck portion and a volume of a hollow portion of the Helmholtz resonator, and the side branch resonator includes a resonance frequency adjusted by a length of the side branch resonator and a number of side branches in the side branch resonator.

9. The silencer of claim 8, further comprising a tail cap covering at least a portion of the tail pipe extending from the downstream end of the inner cylinder, wherein the resonator is formed within the tail cap.

10. The silencer of claim 9, further comprising a middle cylinder disposed around the inner cylinder so as to be interposed between the inner cylinder and the outer cylinder, wherein the first space is arranged between the middle cylinder and the inner cylinder, and a second space in gas communication with the first space is arranged between the middle cylinder and the outer cylinder and is filled with air.

* * * * *